US005860782A

United States Patent [19]

Campbell

[11] Patent Number: 5,860,782

[45] Date of Patent: Jan. 19, 1999

[54] CONTAINER SEAMING APPARATUS AND METHODS

[75] Inventor: Robert H. Campbell, Brookhaven, Pa.

[73] Assignee: ABC Seamer Technologies, Inc., Aston, Pa.

[21] Appl. No.: 996,874

[22] Filed: Dec. 23, 1997

[51] Int. Cl.[6] ..... B21D 51/26

[52] U.S. Cl. ..... 413/6; 413/27; 413/31

[58] Field of Search ..... 413/2, 3, 4, 5, 413/6, 7, 31, 40, 41, 43, 27, 26; 53/334, 338, 488, 486, 485

[56] References Cited

U.S. PATENT DOCUMENTS

| | | | |
|---|---|---|---|
| 635,608 | 10/1899 | Steward . | |
| 648,037 | 4/1900 | Leffler . | |
| 1,862,290 | 6/1932 | Anderson . | |
| 2,150,002 | 3/1939 | Link | 413/5 X |
| 2,216,082 | 9/1940 | Kronquest et al. . | |
| 2,391,684 | 12/1945 | Diezel . | |
| 3,033,264 | 5/1962 | Henrickson | 413/27 X |
| 4,633,553 | 1/1987 | Chronis et al. | 29/557 X |
| 4,662,153 | 5/1987 | Wozniak | 53/331.5 |
| 4,961,300 | 10/1990 | Mihara et al. | 413/27 X |
| 5,228,274 | 7/1993 | De Man et al. | 53/510 |
| 5,358,369 | 10/1994 | Katou et al. | 413/27 |

OTHER PUBLICATIONS

"Cost Effective Conversion from Vacuum Packing to Gas Flushing," Jescorp Packaging Machinery & Electronics, copyright dated 1996, downloaded from Jescorp website (www.jescorp.com/canco.htm1) on Sep. 8, 1997, 3 pages.

Product catalog description of 3 can seaming machines: Irregular Can Seaming Machine—BMT: SPS 200; Round Can Seaming Machine—SRS 200; Can Seaming Machine SRS:200:SB with Control Unit BMT: P–200 for Round Cans, downloaded from Bubber Machine Tools website (www.optimal–india.com/bubber/catalog.htm) on Sep. 8, 1977, 3 pages.

Assembly view (vertical cross–section thru valves and hoist) of CANCO 117 seaming machine, Canco, Greenwich, Connecticut, date unknown, 1 page (numbered –53–).

Catalog pages for Step Motor Drivers. Introduction to Step Motor Drivers; SD8055 Microstep Motor Driver; SD8055 Installation. AMCI, pp. 4 and 10–17.

(List continued on next page.)

*Primary Examiner*—James F. Coan

*Attorney, Agent, or Firm*—Panitch Schwarze Jacobs & Nadel, P.C.

[57] ABSTRACT

A container seaming machine has a first drive for positioning a seaming roller with respect to a circumferential edge of the lid, and a second drive for rotating the seaming roller with respect to a container lid chuck, container body and container lid. The first drive and the second drive are independently controllable from each other, and each drive is controlled and coordinated by a programmable controller to seam the lid to the container body. Another drive, also controlled by the programmable controller, lifts the container body toward the chuck and allows for varying degrees of force to be exerted between the container body and the lid. The drives use servomotors and linear actuators for precise positioning control. A process for displacing air from containers prior to seaming a lid to a container is also provided. In the process, a container body is filled with contents and is then injected with liquid nitrogen. A lid is immediately placed on the container body, and a biasing force is immediately applied against the lid to maintain the lid on the liquid nitrogen filled container bodies until the container body reaches the seaming mechanism. The biasing force is sufficient to allow a portion of nitrogen gas from vaporization of the liquid nitrogen to escape from the container body, and to allow air originally present in the container body to escape from the container body, while preventing surrounding air from entering the container body.

42 Claims, 13 Drawing Sheets

OTHER PUBLICATIONS

Catalog for ET Series Electro–Thrust Electric Cylinder, Catalog 1890, Parker Motion & Control, Parker Hannifin Corporation, Automation Actuator Division, Wadsworth, Ohio, Jul. 1994.

SLC 500™ Family of Small Programmable Controllers, System Overview catalog, Publication 1747–2.30, Allen–Bradley, Milwaukee, Wisconsin, Aug. 1993.

User's Manual for Allen–Bradley Stepper Controller Module, Catalog No. 1746–HSTP1, Allen–Bradley, Milwaukee, Wisconsin, Jun. 1996.

Brochure for Panelview™ 550 Operator Terminals/Panelbuilder™ 550 Software, Publication 2711–1.3, Allen–Bradley, Milwaukee, Wisconsin, Jan. 1994.

"Double Seam Terminology", date unknown, 1 page.

Screen Summary Report

Screen 1 - Motor Status

| ID, | Tag Name, | Object Name, | Position, | Outline, | View, | Touch, | Fkey |
|---|---|---|---|---|---|---|---|
| 203, | Motor_Jog, | Momentary Push Button, | (192, 0), | (64, 48), | On , | On , | F4 |
| 214, | , | Goto Screen Selector, | (208, 96), | (48, 32), | On , | On , | F10 |
| 218, | Machine_AutoManual, | Control List Selector, | ( 96, 64), | (75, 23), | On , | Off | |
| 318, | , | Text, | ( 88, 48), | (85, 10), | On , | Off | |
| 829, | Validate_Roll_Position, | Momentary Push Button, | ( 0, 0), | (80, 48), | On , | On , | F6 |
| 860, | Motor_Stop, | Momentary Push Button, | ( 0, 80), | (64, 48), | On , | On , | F2 |
| 921, | Motor_Start, | Momentary Push Button, | (112, 96), | (48, 32), | On , | On , | F1 |

Screen 2 - Motor Speed

| ID, | Tag Name, | Object Name, | Position, | Outline, | View, | Touch, | Fkey |
|---|---|---|---|---|---|---|---|
| 348, | | Goto Screen Selector, | (208, 96), | ( 48, 32), | On , | On , | F10 |
| 351, | Motor Speed_Ind, | Bar Graph, | (180, 25), | ( 16, 96), | On , | Off | |
| 353, | , | Scale, | (170, 25), | ( 5, 96), | On , | Off | |
| 355, | , | Text, | (135, 25), | ( 27, 10), | On , | Off | |
| 360, | , | Text, | (150, 115), | ( 17, 13), | On , | Off | |
| 363, | , | Text, | (115, 0), | (112, 16), | On , | Off | |
| 371, | motor_speed, | Numeric Entry Cursor Pt, | ( 16, 32), | ( 64, 16), | On , | On | |
| 376, | , | Text, | ( 15, 15), | ( 72, 10), | On , | Off | |
| 384, | , | Text, | ( 90, 35), | ( 32, 10), | On , | Off | |
| 388, | Motor_Speed_Ind, | Numeric Data Display, | (205, 30), | ( 43, 15), | On , | Off | |
| 399, | , | Text, | (210, 50), | ( 32, 15), | On , | Off | |
| 860, | Motor_Stop, | Momentary Push Button, | ( 16, 64), | ( 64, 48), | On , | On , | F2 |

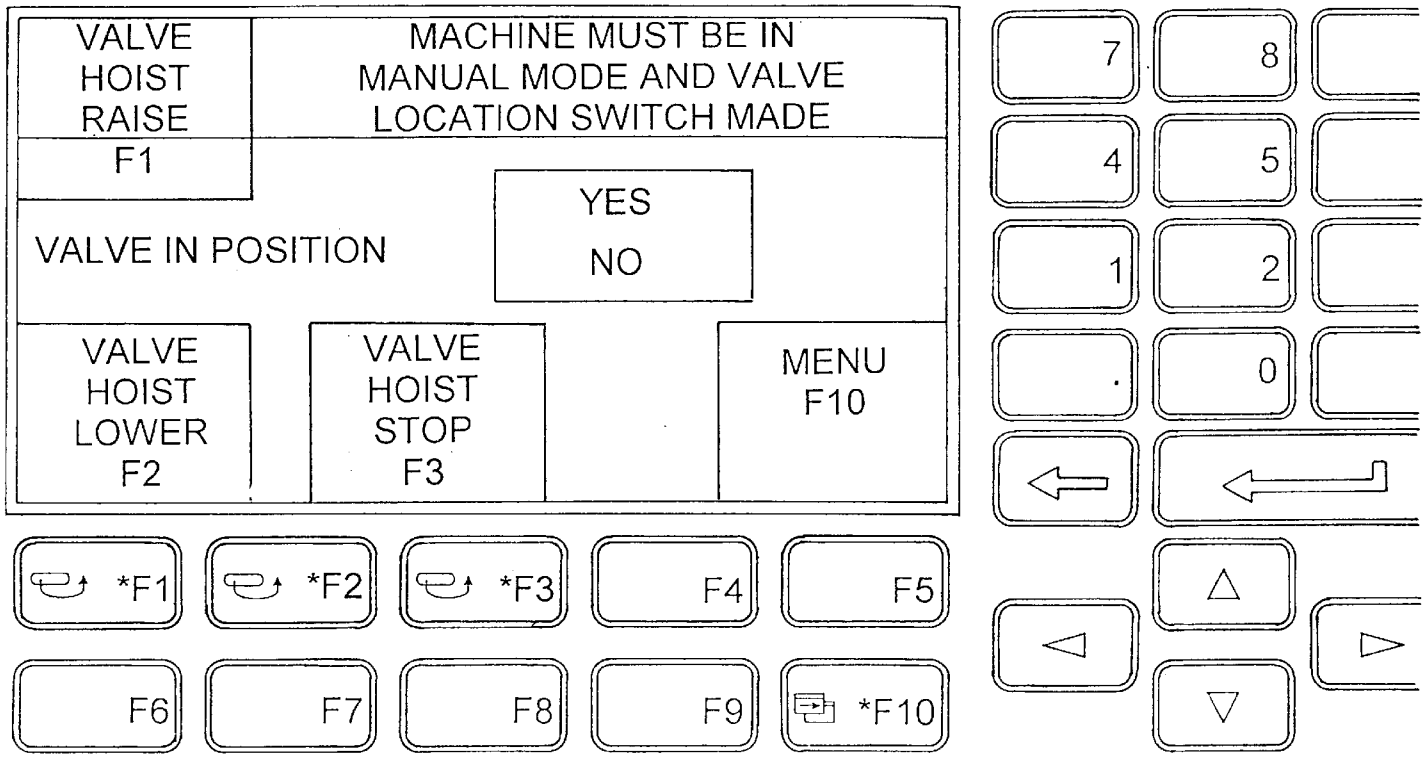

Fig. 5C

Screen Summary Report

Screen 3 - Valve Service

| ID, | Tag Name, | Object Name, | Position, | Outline, | View, | Touch, | Fkey |
|---|---|---|---|---|---|---|---|
| 403, | Valve_Hoist_Raise, | Momentary Push Button, | ( 0, 0), | ( 64, 48), | On , | On , | F1 |
| 426, | Valve_Hoist_Lower, | Momentary Push Button, | ( 0, 80), | ( 64, 48), | On , | On , | F2 |
| 437, | valve_hoist_stop, | Momentary Push Button, | ( 80, 80), | ( 64, 48), | On , | On , | F3 |
| 448, | , | Goto Screen Selector, | (192, 80), | ( 64, 48), | On , | On , | F10 |
| 451, | , | Rectangle Drawing, | (130, 40), | ( 72, 35), | On , | Off | |
| 453, | Valve_Pos_Ind, | Multistate Indicator, | (150, 45), | ( 30, 10), | On , | Off | |
| 471, | Valve_Pos_Ind, | Multistate Indicator, | (150, 60), | ( 30, 10), | On , | Off | |
| 481, | , | Text, | ( 0, 55), | (112, 16), | On , | Off | |
| 489, | , | Text, | ( 85 5), | (165, 30), | On , | Off | |

Fig. 5D

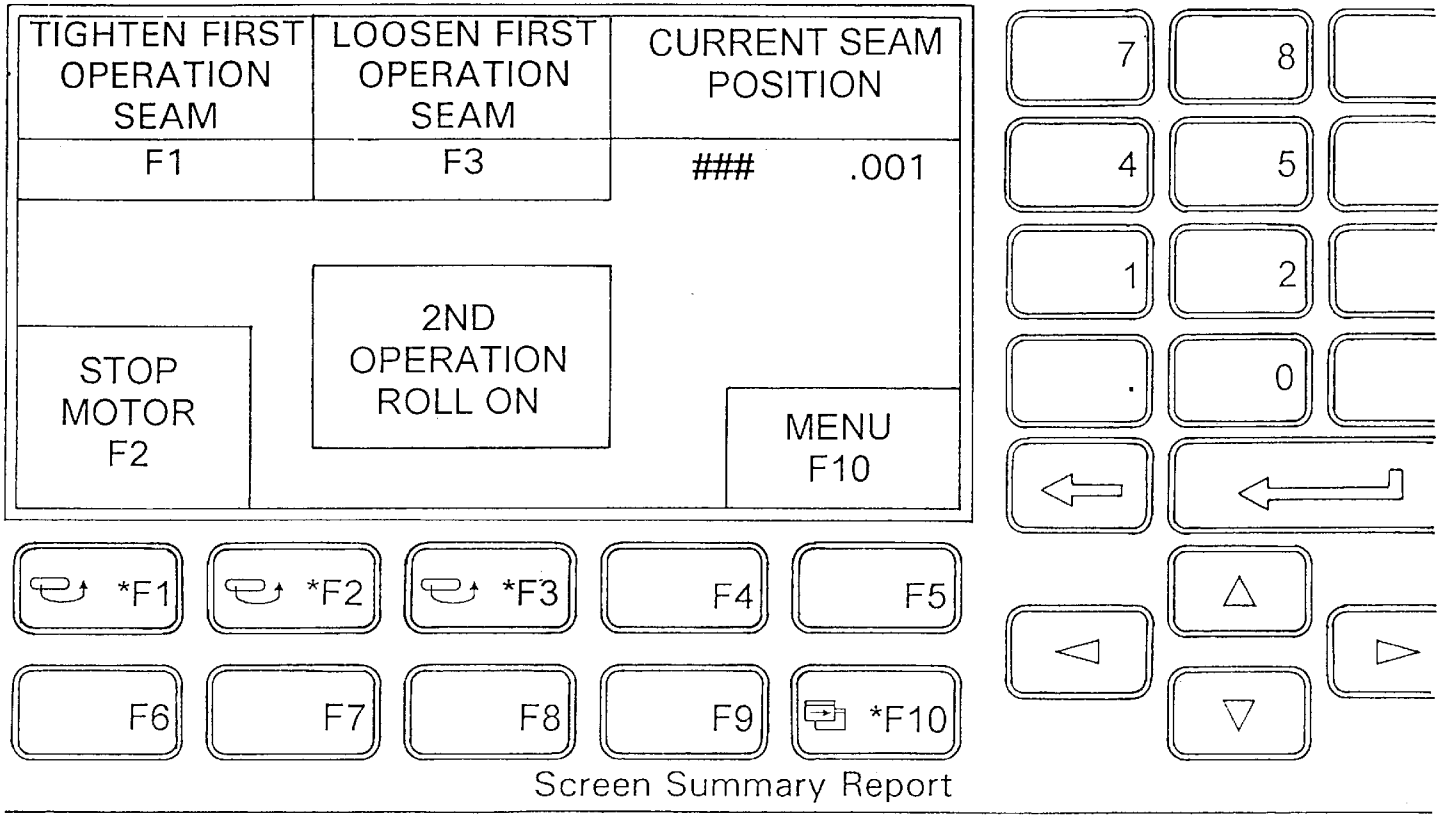

Screen Summary Report

Screen 4 -1 st. opper. adjustments

| ID, | Tag Name, | Object Name, | Position, | Outline, | View, | Touch, | Fkey |
|---|---|---|---|---|---|---|---|
| 498, | Tighten_1st_opp_seam, | Momentary Push Button, | ( 0, 0), | (80, 48), | On , | On , | F1 |
| 507, | Loosen_1st_opp_seam, | Momentary Push Button, | ( 80 0), | (80, 48), | On , | On , | F3 |
| 515, | , | Goto Screen Selector, | (192, 96), | (64, 32), | On , | On , | F10 |
| 551, | First_Seam_Ind, | Numeric Data Display, | (168, 32), | (48, 16), | On , | Off | |
| 557, | , | Text, | (216, 32), | (40, 16), | On , | Off | |
| 560, | , | Text, | (168, 0), | (88, 24), | On , | Off | |
| 860, | Motor_Stop, | Momentary Push Button, | ( 0, 80), | (64, 48), | On , | On , | F2 |
| 985, | Second_Opperation_On_Seam, | Maintained Push Button, | ( 80, 64), | (80, 48), | On , | On | |

Screen Summary Report

Screen 5 - 2nd opper. adjustments

| ID, | Tag Name, | Object Name, | Position, | Outline, | View, | Touch, | Fkey |
|---|---|---|---|---|---|---|---|
| 575, | , | Text, | (170, 0), | ( 86, 24), | On , | Off | |
| 583, | Second_Seam_Ind, | Numeric Data Display, | (165, 30), | ( 43, 16), | On , | Off | |
| 588, | , | Goto Screen Selector, | (192, 64), | ( 48, 48), | On , | On , | F10 |
| 592, | , | Text, | (220, 35), | ( 35, 16), | On , | Off | |
| 596, | Tighten_2nd_opp_seam, | Momentary Push Button, | ( 0, 0), | ( 80, 48), | On , | On , | F1 |
| 604, | Loosen_2nd_opp_seam, | Momentary Push Button, | ( 80, 0), | ( 80, 48), | On , | On , | F3 |
| 860, | Motor_Stop, | Momentary Push Button, | ( 64, 64), | ( 64, 48), | On , | On , | F2 |

Fig. 5F

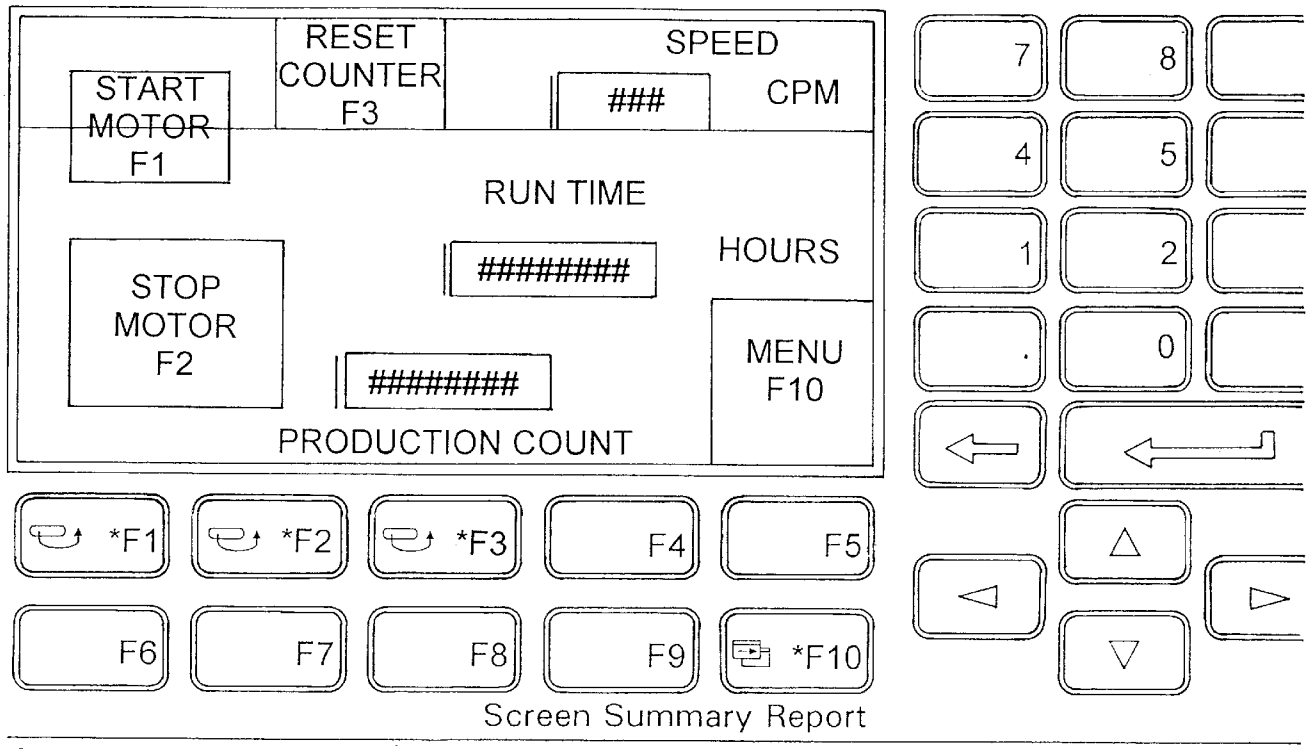

Screen Summary Report

Screen 6 - Machine Operation

| ID, | Tag Name, | Object Name, | Position, | Outline, | View, | Touch, | Fkey |
|---|---|---|---|---|---|---|---|
| 628, | Motor_Run_Time_Ind, | Numeric Entry Cursor Pt, | (128, 64), | ( 64, 16), | On , | On | |
| 633, | Motor_Speed_Ind, | Numeric Entry Cursor Pt, | (160, 16), | ( 48, 16), | On , | On | |
| 638, | Production_Ct_Ind, | Numeric Entry Cursor Pt, | ( 96, 96), | ( 64, 16), | On , | On | |
| 643, | , | Goto Screen Selector, | (208, 80), | ( 48, 48), | On , | On , | F10 |
| 666, | , | Text, | (205, 60), | ( 40, 15), | On , | Off | |
| 662, | , | Text, | (140, 45), | ( 55, 10), | On , | Off | |
| 674, | , | Text, | ( 75, 115), | (115, 13), | On , | Off | |
| 678, | , | Text, | (220, 15), | ( 30, 15), | On , | Off | |
| 682, | , | Text, | (180, 0), | ( 56, 10), | On , | Off | |
| 686, | Reset_Ct, | Momentary Push Button, | ( 80, 0), | ( 48, 32), | On , | On | , F3 |
| 912, | Motor_Start, | Momentary Push Button, | ( 16, 16), | ( 48, 32), | On , | On | , F1 |
| 860, | Motor_Stop, | Momentary Push Button, | ( 16, 64), | ( 64, 48), | On , | On | , F2 |

| Screen Alarm Banner ID, | Tag Name, | Object Name, | Position, | Outline, | View, | Touch, | Fkey |
|---|---|---|---|---|---|---|---|
| 796, | , | Alarm Banner Drawing, | ( 0, 32), | (256, 96), | On , | Off | |
| 798, | , | Text, | ( 16, 40), | (224, 24), | On , | Off | |
| 802, | , | Clear Alarm Button, | ( 16, 80), | ( 48, 32), | On , | On | , F6 |
| 806, | , | Alarm Acknowledgment Button, | (192, 80), | ( 48, 32), | On , | On | , F7 |

CONTAINER SEAMING APPARATUS AND METHODS

BACKGROUND OF THE INVENTION

The present invention relates generally to seaming machines. A seaming machine is used to seam a lid to a contents-filled container body so as to form a sealed container. The seaming machine typically has two seaming rollers associated with the seaming machine to form a sanitary seam, also called a double seam, between the container body and the lid.

Conventional seaming rollers are positioned by mechanical cams controlled by mechanical drives, gear trains and the like, all of which are carefully coordinated and interlinked with a drive that rotates the container body with respect to the seaming rollers. Due to the complex linkages uses in conventional seaming machines and reliance on primarily mechanical drives, it is very time-consuming to make adjustments to a seaming machine when the machine becomes out of tolerance, or if a different size container is used. For example, it may take as long as an entire workday, as well as the swapping of parts, to change a machine if a different container size is used. The changeover results in lost production time and requires skilled, hard to find,, machine operators. A conventional seaming machine, by virtue of its inherent design, is also limited in the range of different container sizes that it can be adjusted to handle.

When packaging goods which spoil due to exposure to air, the air is removed from the container before the lid is sealed thereon. One process for removing the air and which avoids the necessity to seam under a vacuum, is to inject liquid nitrogen into the container before the lid is seamed onto the container. As the liquid nitrogen vaporizes, the resultant nitrogen gas drives out the air. This process requires precise timing to ensure that substantially all of the liquid nitrogen vaporizes and that no air leaks back into the container before the lid is seamed on. It is very difficult to achieve the precise timing.

Accordingly, there is a need for seaming machines and processes which overcome the problems discussed above.

BRIEF SUMMARY OF THE INVENTION

A container seaming machine is provided which includes a seaming chuck, a seaming roller and a first and a second drive. The seaming chuck holds a lid firmly against an end of a container body during a seaming operation. The first drive is connected to the seaming roller and positions the seaming roller with respect to a circumferential edge of the lid. The second drive causes rotation of the seaming chuck, thereby causing rotation of the container body and container lid. The first drive and the second drive are independently controllable from each other. A programmable controller provides the separate control and coordination of the two drives. A method of seaming a lid to a container body by using the container seaming machine is also provided. The first drive may include a servomotor and a linear actuator. The servomotor receives control data related to the desired position of the seaming roller with respect to the circumferential edge of the container body, and the container lid. The linear actuator translates a servomotor output to cause movement of the seaming roller.

Another embodiment of the invention provides a container seaming machine for performing a seaming operation on a container body and lid by using a seaming roller. The machine includes a seaming chuck, a base surface, a drive and a pressure sensor. The seaming chuck holds the lid firmly against an end of the container body during a seaming operation. The other end of the container body is placed on the base surface. The drive causes the base surface to move toward the seaming chuck so that the end of the container body and the lid are held firmly against the seaming chuck and so that the container body and lid are in position for performing the seaming operation. The end of the container body and the lid exert a force against each other which is determined by the final position of the drive. In this manner, the final position of the drive is adjustable so that the drive may cause varying degrees of force to be exerted between the container body and the lid. The pressure sensor is associated with an output of the drive. The pressure sensor measures the force exerted between the container body and the lid. The measured force is used to determine the final position of the drive.

Another embodiment of the invention provides a process to displace air from containers prior to seaming a lid to a container. In the process, a container body is filled with contents and is then injected with liquid nitrogen. A lid is immediately placed on the container body, and a biasing force is immediately applied against the lid to maintain the lid on the liquid nitrogen filled container bodies until the container body reaches the seaming mechanism. The biasing force is sufficient to allow a portion of nitrogen gas from vaporization of the liquid nitrogen to escape from the container body, and to allow air originally present in the container body to escape from the container body, while preventing surrounding air from entering the container body. The biasing force is applied for a period of time which is sufficient to allow substantially all of the liquid nitrogen to vaporize, and thereby displace substantially all of the air originally present in the container body. The biasing force may be applied by a spring loaded rail. An apparatus for performing this process is also provided.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIGS. 5A–5H are sample display screens and their respective screen summary reports for a programmable controller which is shown in FIG. 1 and which controls the seaming machine of FIG. 1.

DETAILED DESCRIPTION OF THE INVENTION

Figure 1:
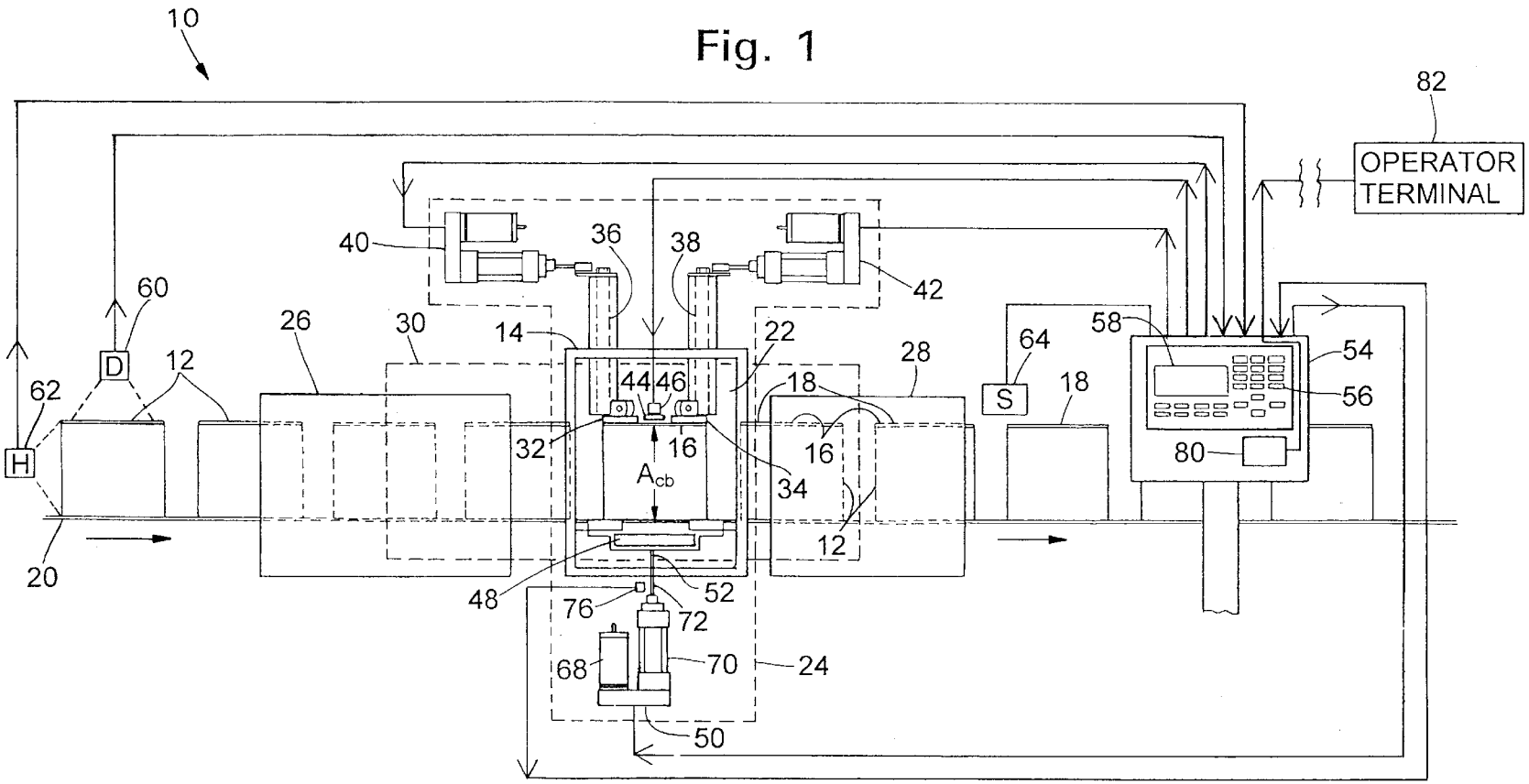
FIG. 1 is a schematic illustration of an assembly line process which uses a container seaming machine in accordance with the present invention.

In the drawings, the same reference numerals are employed for designating the same elements throughout the several figures.

FIG. 1 shows an assembly line 10 for moving content-filled container bodies 12 through a seaming station 14 which seams lids 16 to the container bodies 12 to form lidded, sealed containers 18. The assembly line 10 includes a conveyor 20 for moving the container bodies 12 and the seamed containers 18. The seaming station 14 defines a vacuum chamber 22 having a seaming machine 24 therein. The individual components of the seaming machine 24 are described in detail below.

The container seaming machine 24 described herein seams lids to container bodies under a vacuum state. To accomplish this task, the assembly line 10 further includes an inlet or entrance feed valve 26 and a discharge or exit feed valve 28, each of which have respective inlets and outlets in fluid communication with the seaming station 14. The entrance feed valve 26 introduces the container bodies 12 to the vacuum chamber 22 of the seaming station 14. Vacuum begins to be pulled on the container bodies 12 as the container bodies 12 pass through the feed valve 26. The exit feed valve 28 removes the lidded, sealed containers 18 from the seaming station 14.

The region of FIG. 1 labeled as 30 is a vacuum region, the highest vacuum occurring in the vacuum chamber 22. Thus, while not illustrated in FIG. 1, the outlet of the entrance feed valve 26 and the inlet of the exit feed valve 28 are in fluid communication with each other and are sealed from the surrounding environment. An integrated seaming mechanism which has an entrance feed valve 26, a seaming station 14 under vacuum, and an exit feed valve 28 is conventional, and thus is not described in detail herein. One example of such a mechanism is a CANCO 117 seaming machine, made by Canco, Greenwich, Conn. The feed valves 26 and 28 in such a mechanism use turrets to move the container bodies 12 from the valve inlets to the valve outlets. The feed valves 26 and 28 may be similar to the feed valves in the Canco machine, or they may be similar to feed valves of other types of conventional vacuum-operated seaming mechanisms.

While the disclosed embodiment of the present invention seams under vacuum, the vacuum environment is not a necessary feature of the invention, and the seaming may occur at atmospheric pressure. Thus, the vacuum chamber 22 is optional, the feed valve 26 need not necessarily draw a vacuum, and the outlet of the feed valve 26 and the inlet of feed valve 28 need not necessarily be in fluid communication to maintain a vacuum. A less complex feed process may also be used in place of the feed valves 26 and 28 to deliver container bodies 12 to, and remove lidded containers 18 from, the seaming station 14.

Seaming machines use seaming heads which have seaming rolls or seaming rollers attached thereto for performing the seaming function. In one type of seaming machine, a seaming chuck holds a lid firmly against a top end of a container body so that the lid is held in contact with the top end of the container body. A first mechanical drive positions the two seaming rollers with respect to a circumferential edge of the lid. A second drive on the seaming machine rotates the seaming roller with respect to the chuck, container body and container lid. There is typically one motor which has two power takeoffs, one for each of the drives. In one conventional configuration, the chuck, container body and lid remain stationary, and the second drive rotates the seaming roller around the container body and lid. In another conventional configuration, a second drive on the seaming machine rotates the chuck, which, in turn, rotates the container body and lid. There are typically two seaming rollers on a seaming machine used for food products. The two seaming rollers form a sanitary seam, called a double seam, between the container body and the lid. The first roller begins to roll the lid and the container body, forming a first operation roll seam, and the second roller completes the seam, forming the second operation roll seam. The resultant seam is airtight.

The seaming machine 24 has two such seaming rollers 32 and 34 linked to respective seaming roll shafts 36 and 38. The rollers 32 and 34 are of conventional design, and thus not described in detail herein. The shafts 36 and 38 are described in detail below. While the seaming machine 24 has two seaming rollers, the present invention is equally applicable to a seaming machine which has only one seaming roller.

Conventional seaming rollers are positioned by mechanical cams controlled by mechanical drives, gear trains and the like, all of which are carefully coordinated and interlinked with the second drive that rotates the container body with respect to the seaming rollers. To change the settings of a conventional seaming machine, such as to accommodate a different container diameter or to correct a "seam out-of-tolerance" condition, the entire machine must be shut down and a very time-consuming resetting procedure must be performed. A changeover to a different container diameter may take several hours. Furthermore, conventional seaming machines typically require thousands of dollars of change parts to handle a different container sizes.

One important feature of the present invention is that the seaming rollers 32 and 34 are positioned by drives that are independently controllable from, or independent of, the drive that rotates the seaming rollers 32 and 34 with respect to a circumferential edge of the lid 16 to be seamed to the container body 12. That is, the two drives are separate, mechanically unlinked motive means. There are no mechanical cams. Adjustments may be made to one drive without affecting the other. In this manner, the seaming roller drive (or seaming roller drives if there are two seaming rollers) may be positioned more easily, and without having to shut down the machine or adjust any gears or the like within the seaming machine. The seaming roller drives may even be adjusted while the seaming machine is in operation (i.e., "on-the-fly") and without having to stop the seaming machine at all. Furthermore, different container sizes may be run through the same seaming machine with a minimum of extra tooling.

The seaming roller drives must be coordinated with the drive that rotates the seaming rollers 32 and 34 with respect to a circumferential edge of the lid 16 to be seamed to the container body 12. In the present invention, this coordination is performed by a controller, preferably, a programmable controller which executes a programmable logic control (PLC) program. The programmable controller provides significantly more flexibility than the conventional approach of mechanically synchronizing seaming machine drives.

Referring again to FIG. 1, the seaming machine 24 includes a first seaming roller drive 40 and a second seaming roller drive 42. The first seaming roller drive 40 is linked via the roll shaft 36 to the seaming roller 32, and the second seaming roller drive 42 is linked via the roll shaft 38 to the seaming roller 34. The drives 40 and 42 adjustably position the circumferential edge of the respective seaming rollers 32 and 34 toward and away from a center axis $A_{cb}$ of the container body 12, thereby positioning the seaming rollers 32 and 34 with respect to the circumferential edge of the lid 16 to perform a seaming operation.

The seaming machine 24 is of the type wherein a seaming chuck holds the lid 16 firmly against the top end of the container body during the seaming operation, and a drive rotates the chuck, thereby causing rotation of the container body 12 and container lid 16 (and the chuck) in unison. The seaming chuck and drive are schematically shown and are labeled as 44 and 46, respectively. The present invention may alternatively be used with a seaming machine 24 wherein a chuck, container body and lid remain stationary, and a drive rotates the seaming roller around the container body and lid. In either configuration, the first and second seaming roller drives 40 and 42 are independently controllable from the drive which rotates the seaming rollers 40 and 42 with respect to the chuck. In the disclosed example of the present invention, the first and second seaming roller drives 40 and 42 are thus independently controllable from the drive 46 that rotates the chuck 44, as described in more detail hereafter.

The seaming machine 24 also has a vertically movable base surface or base plate 48 for receiving the container body 12 and for lifting it towards the chuck 44. The base plate 48 is lifted by a base plate drive 50 which is linked via shaft 52 to the base plate 48. In use, a container body 12 and an unattached lid 16 resting on the top end of the container body 12 are placed on the base plate 48, and the container body 12 and unseamed lid 16 move toward the chuck 44 a predetermined vertical distance until the top end of the container body 12 and lid 16 are held firmly against the chuck 44. The top end of the container body 12 and the lid 16 thus exert a force against each other which is determined by the final position of the base plate 48, as determined by the action of the drive 50. The container body 12, lid 16 and chuck 44 remain in the final position during the seaming operation. After the seaming operation is completed, the base plate drive 50 moves the base plate 48 downward to allow the lidded container 18 to be released and to allow a new container body 12 to be placed on the base plate 48. The base plate drive 50 is independently controllable from the roller drives 40 and 42, and from the chuck drive 46, as described in more detail hereafter.

In an alternative embodiment of the invention, the base plate 48 is fixed, and the chuck 44 moves vertically downward to hold the container body 12 and lid 16 firmly together against the base plate 48. In this alternative embodiment, the drive 50 would be linked via the shaft 52 to the chuck 44. In the preferred embodiment of the invention shown in the figures, the seaming rollers 32 and 34 do not move vertically. Accordingly, when a container body is properly positioned in the seaming machine 24, it is only necessary to move the seaming rollers 32 and 34 toward the center axis of a container body 12 to properly position the rollers 32 and 34 to perform a seaming operation. However, if the fixed base plate alternative embodiment is used, it would be necessary to either link the seaming rollers 32 and 34 (and related parts) together with the vertically movable chuck 44 to obtain the proper vertical position for the seaming rollers 32 and 34 for the particular container height, or it would be necessary to independently move the seaming rollers 32 and 34 in a vertical direction using drives similar to the drive 50.

The lid 16 is placed on the top end of the container body 12 before the two items enter the feed valve 26. The mechanism for placing the lids 16 on the succession of container bodies 12 is not shown in FIG. 1. In the embodiment of the invention which does not seam in a vacuum environment, the lid 16 is placed on the container body 12 before the two items are placed on the base plate 48.

To allow for independent controlling of the respective drives, the assembly line 10 preferably includes a programmable controller 54 which executes a programmable logic control (PLC) program stored therein. A sample PLC program, shown as a ladder diagram, appears in the Appendix. Based on the program, control data is output from the controller 54 and sent to the respective drives 40, 42, 46 and 50. One purpose of the programmable controller 54 is to appropriately position the seaming rollers 32 and 34 with respect to the circumferential edge of the lid 16 during rotation of the container body 12, lid 16 and chuck 44 so as to perform a seaming operation. Another purpose of the programmable controller 54 is to control the base plate drive 50 so that the base plate 48 is lifted to the appropriate final position. The program thus coordinates the seaming operation in accordance with the stored program and thereby replaces conventional mechanical linkages which perform similar functions.

The programmable controller 54 includes an operator input panel 56 for allowing at least some of the operating values to be entered into the program, and a display 58 for interfacing with the operator during inputting and for communicating operating status. The programmable controller 54 may optionally receive input data from automated measuring devices or sensors placed along the assembly line 10. For example, there may be a container body diameter sensor 60 and a container height sensor 62 located prior to the seaming station 14. Data from these sensors may be used in place of an operator input values or preset values to set parameters of the program which will control the drives. In particular, the diameter sensor 60 may be used to control the roller drives 40 and 42 and the chuck drive 46, whereas the height sensor 62 may be used to control the base plate drive 50.

Roller drives 40 and 42 may periodically require fine position adjustments due to wear at contact surfaces or due to play in linkage components. An additional feedback sensor 64 may be located after the seaming station 14 to obtain data regarding the quality of the seam (e.g., its width, body hook and cover hook) of seamed containers 18. The feedback data may be analyzed, compared to desired values, and used to make the fine position adjustments to the appropriate drives. Seamed containers may also be manually examined by quality control personnel, and based upon visual inspection, fine position adjustments may be manually entered into the operator input panel 56.

Each production run of containers requires specific drive instructions based upon the container size (e.g., diameter and height), and desired qualities of the seam (e.g., width, body hook and cover hook). These factors are processed by the programmable controller 54 and used to create a set of instructions. The set of instructions are used to output drive control data for each of the seaming machine drives. For example, a container body having a three inch diameter and a six inch height requires a first set of instructions, including position instructions for the roller drives 40 and 42 (to appropriately position the seaming rollers 32 and 34), rotation instructions for the chuck drive 46 and final position instructions for the base plate drive 50, whereas a container body having a two inch diameter and a four inch height requires a second set of instructions that will be completely different from the first set of instructions.

The set of instructions may be initiated at the start of a production run of similar containers to be seamed in the same manner. Alternatively, the set of instructions may be modified during the production run based upon feedback data from the sensor 64. Another alternative embodiment uses the diameter and/or height sensors 60 and 62 to define a new set of instructions "on the fly" without having to stop the seaming machine 24. In this manner, a single production run may include containers of different sizes and/or seam types.

The container diameter may also be used to automatically select "on-the-fly" the appropriate chuck 44 from a plurality of chucks for automatic mounting to a seaming machine. The seaming machine 24 shown in the figures does not have this capability, although it could be provided, if desired. In this manner, a very wide range of container diameters can be processed continuously by the same seaming machine without requiring any downtime for manually changing chucks.

Since the programmable controller 54 has complete control over the drive 46, and because the drive 46 is not mechanically linked to the drives 40 and 42, the direction of the seaming process can be selected. In the seaming machine 24 of FIG. 1, this means that the container body 12 can be spun in reverse during a seaming operation, if desired, thereby maximizing the strength of certain composite containers depending upon how the composite material is wound (e.g., clockwise or counterclockwise around a mandrel). Such composite containers would otherwise be weakened by a forward rotation during a seaming operation.

The programmable controller 54 also includes a remote communication module 80 for bidirectional communication with a remote operator terminal 82. This allows an operator at a remote site to operate the seaming machine 48, program or reprogram the controller 54, and to remotely perform diagnostics.

To simplify the subsequent explanation of the invention, the seaming machine 24 is described with respect to only a single seaming roller and drive, particularly, seaming roller 34 and its corresponding drive 42. The remaining discussion of these components is equally applicable to the seaming roller 32 and its drive 40. Also, the position coordination of two seaming rollers with respect to each other which is required to create a double seam is well known and thus not described in detail herein. However, the process generally works as follows:

(1) The first roller is brought into contact with the lid, and begins to roll the lid and the container body. While the first roller is contacting the lid, the second roller is not in contact with the lid.

(2) Next, the first roller is moved away from (and out of contact with) the lid, and the second roller is brought into contact with the lid to complete the seam.

(3) When the seam is completed, the second roller is moved away from the lid.

Figure 2:
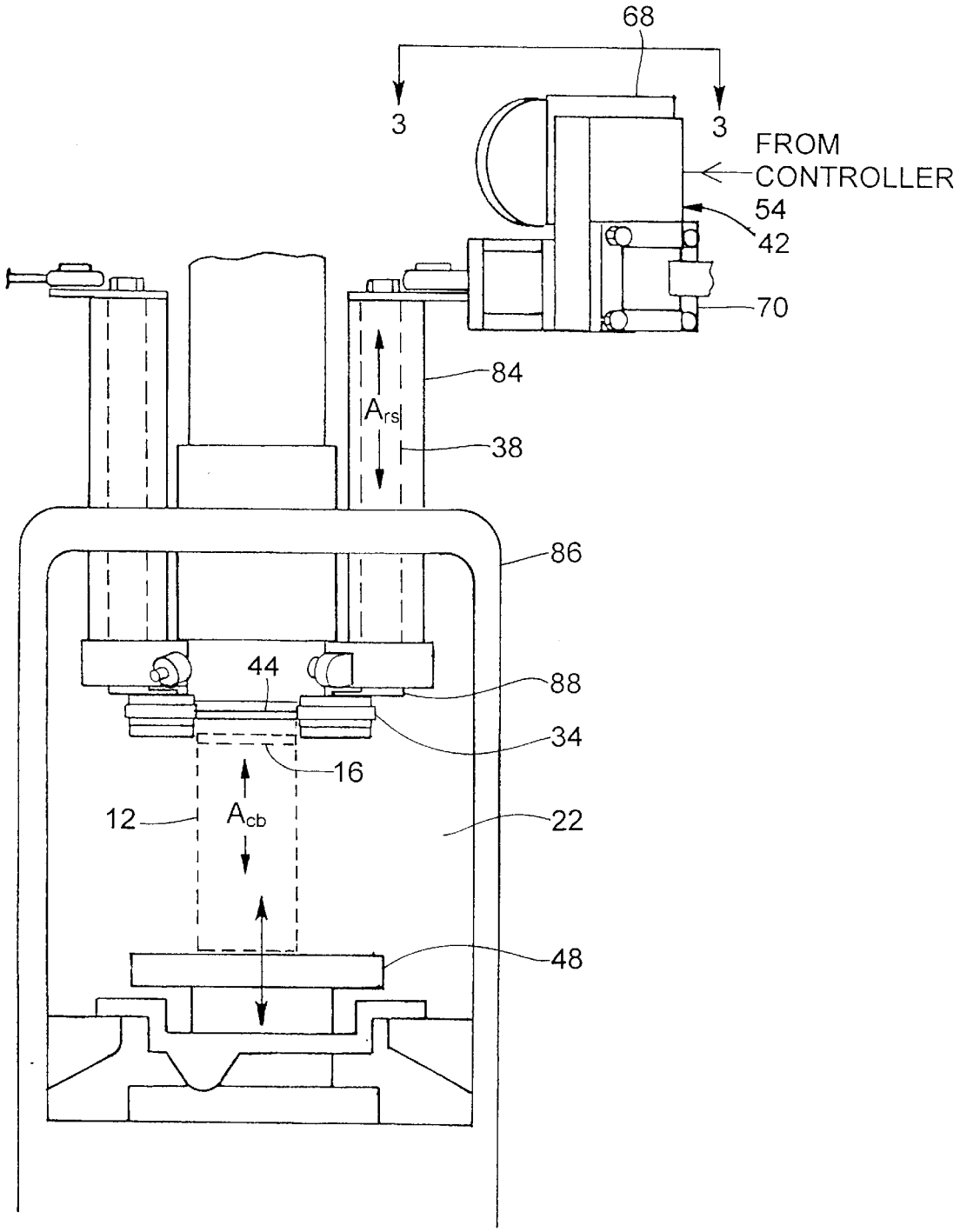
FIG. 2 is an enlarged front elevational view of a portion of the seaming machine of FIG. 1.
Figure 3:
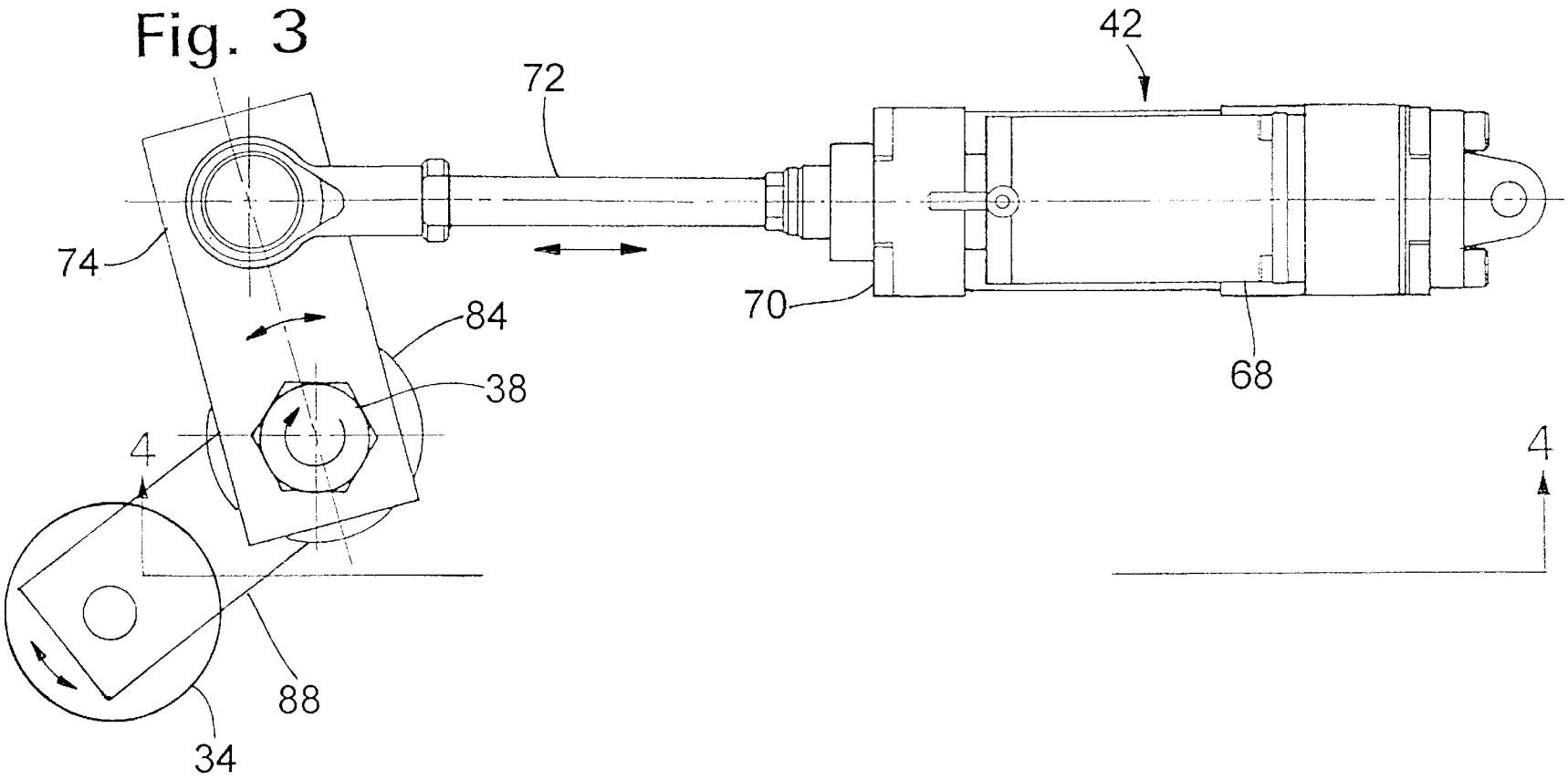
FIG. 3 is a top plan view of a seaming roller drive for the seaming machine of FIG. 2, taken along line 3—3 of FIG. 2.
Figure 4:
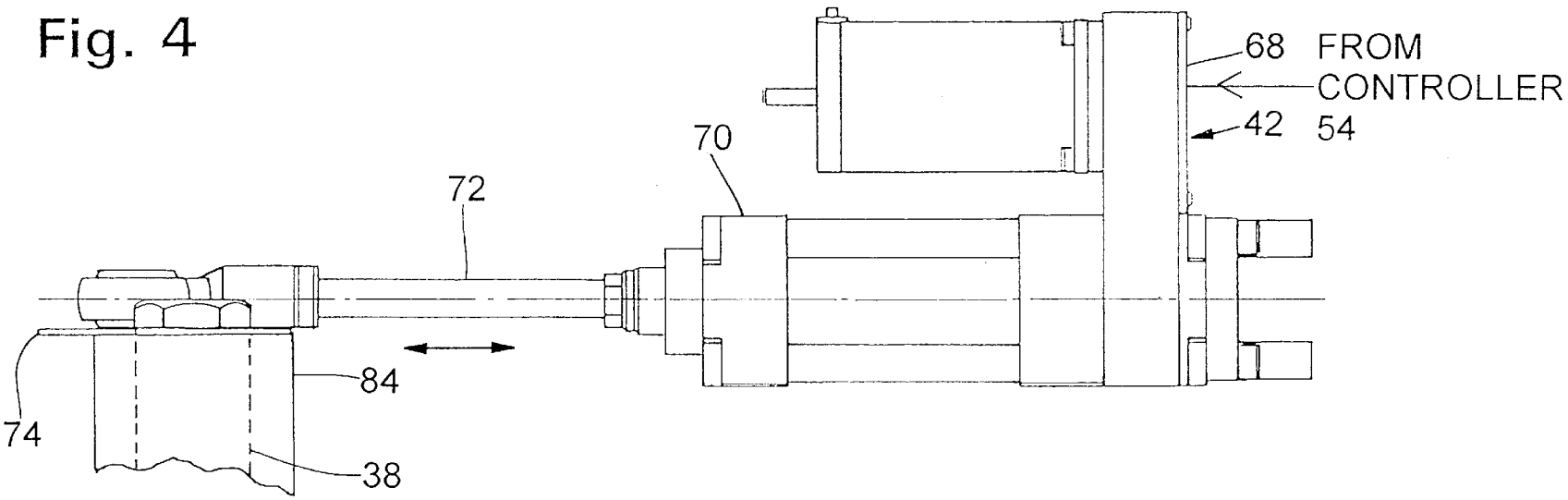
FIG. 4 is an elevation view of the seaming roller drive of FIG. 3, taken along line 4—4 of FIG. 3.
Figure 5A:
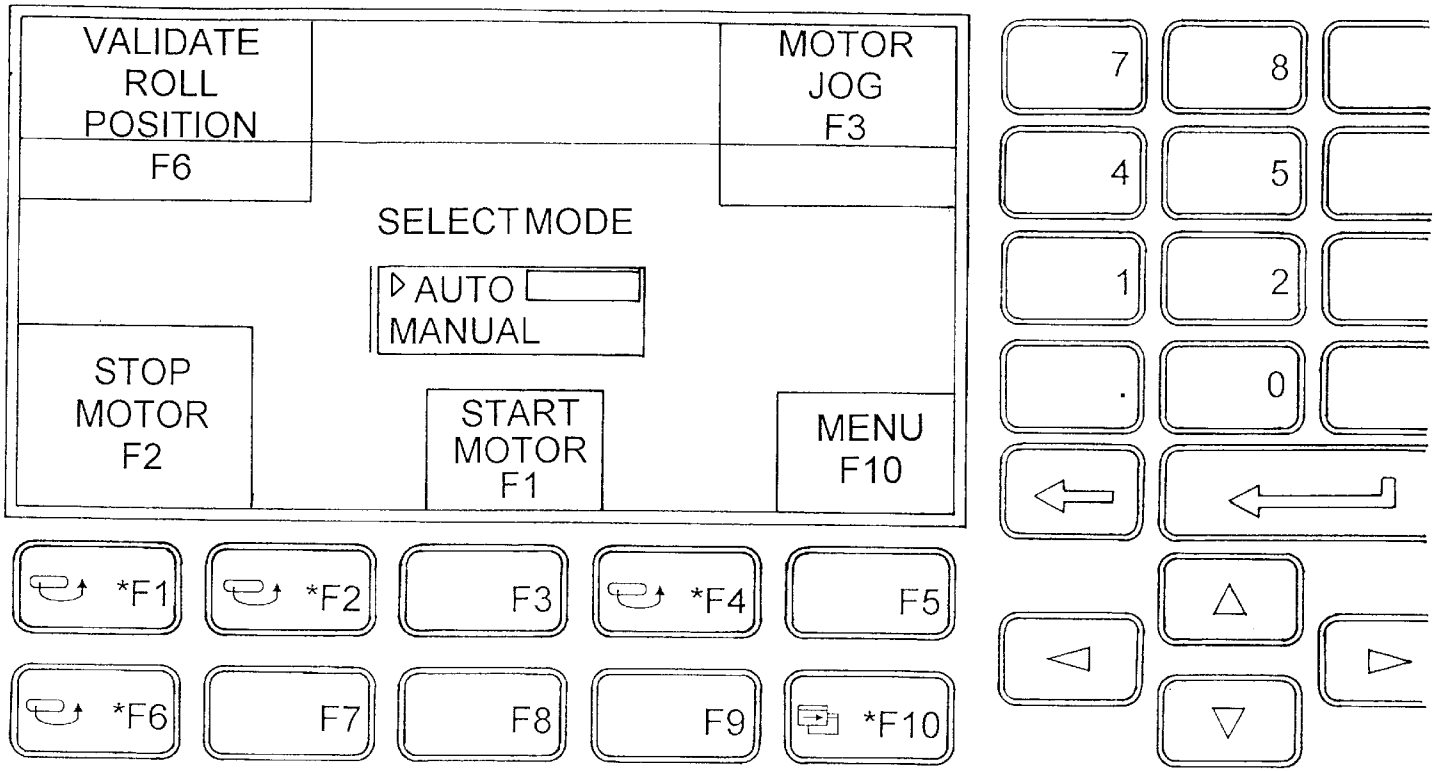
Figure 5B:
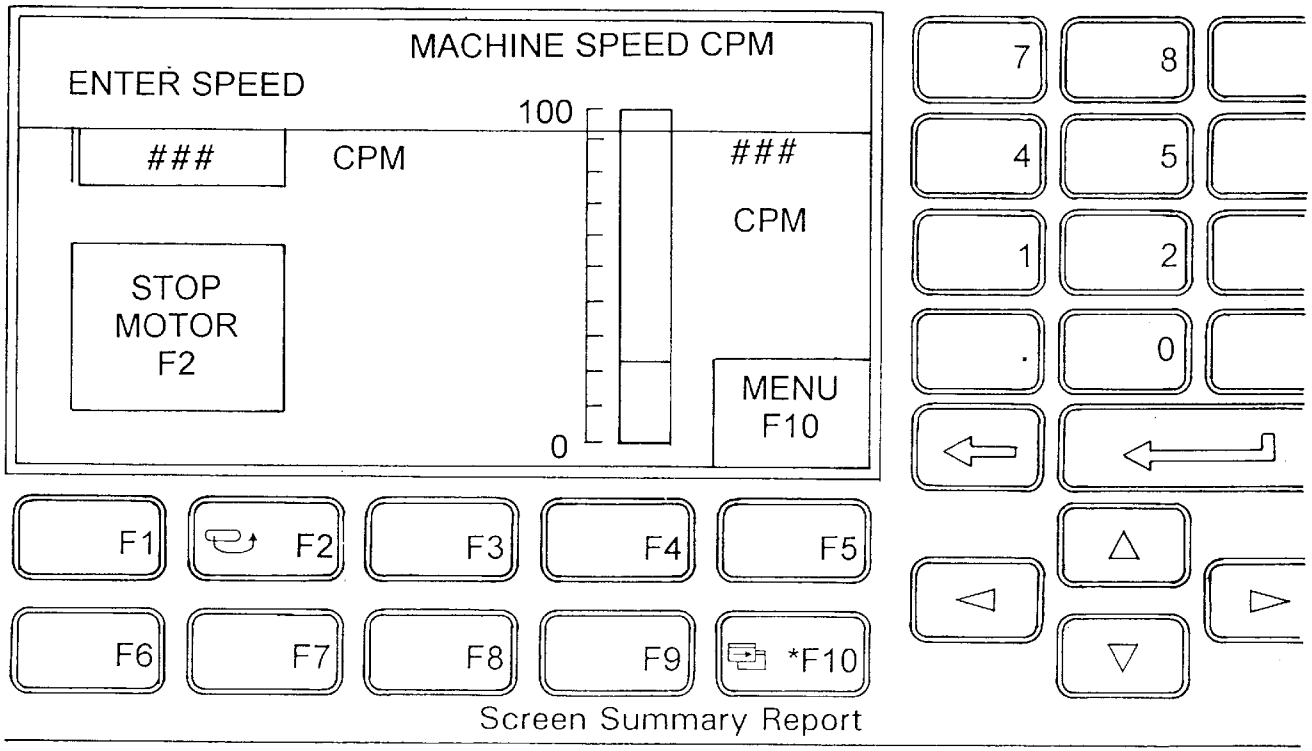
Figure 5E:
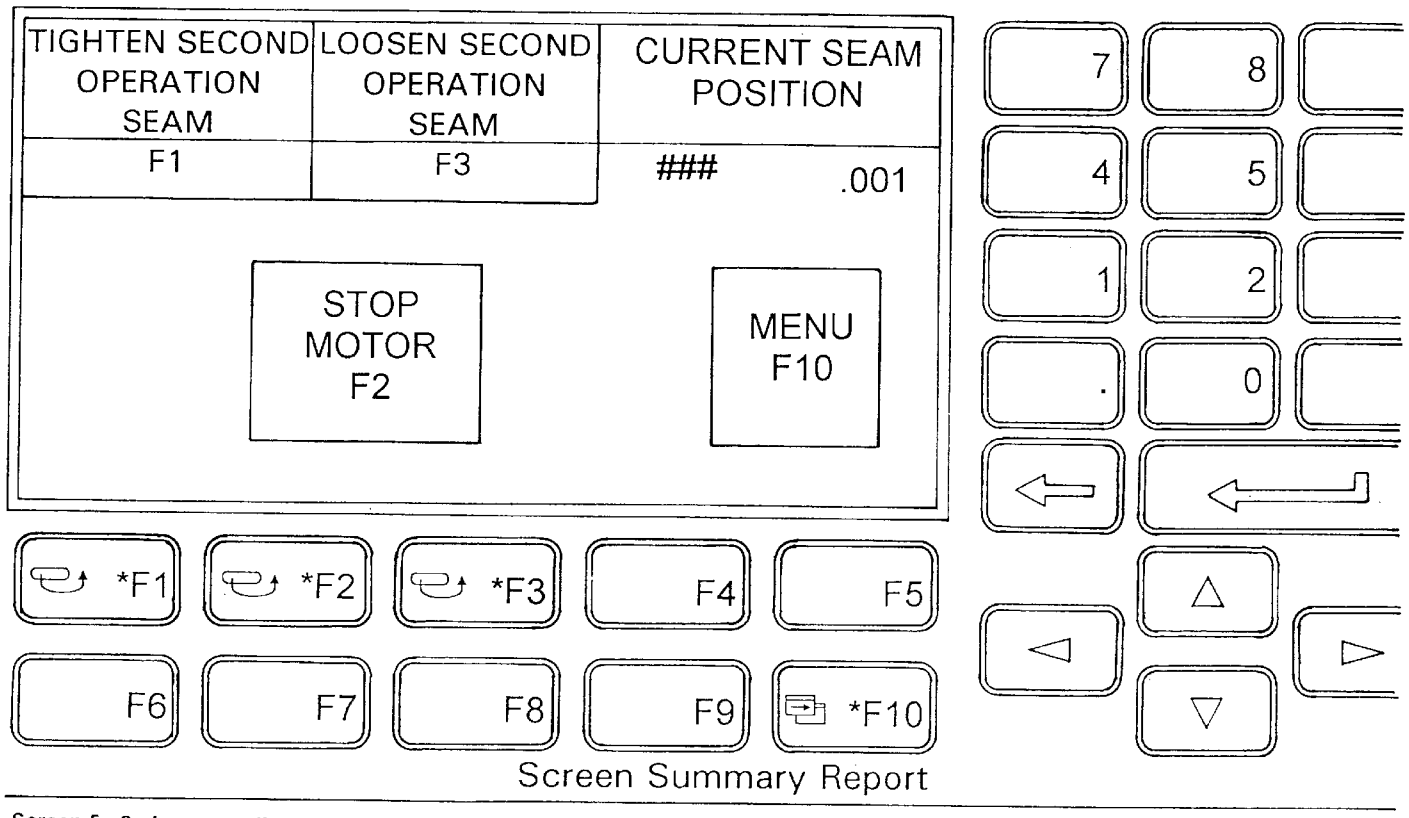
Figure 5G:
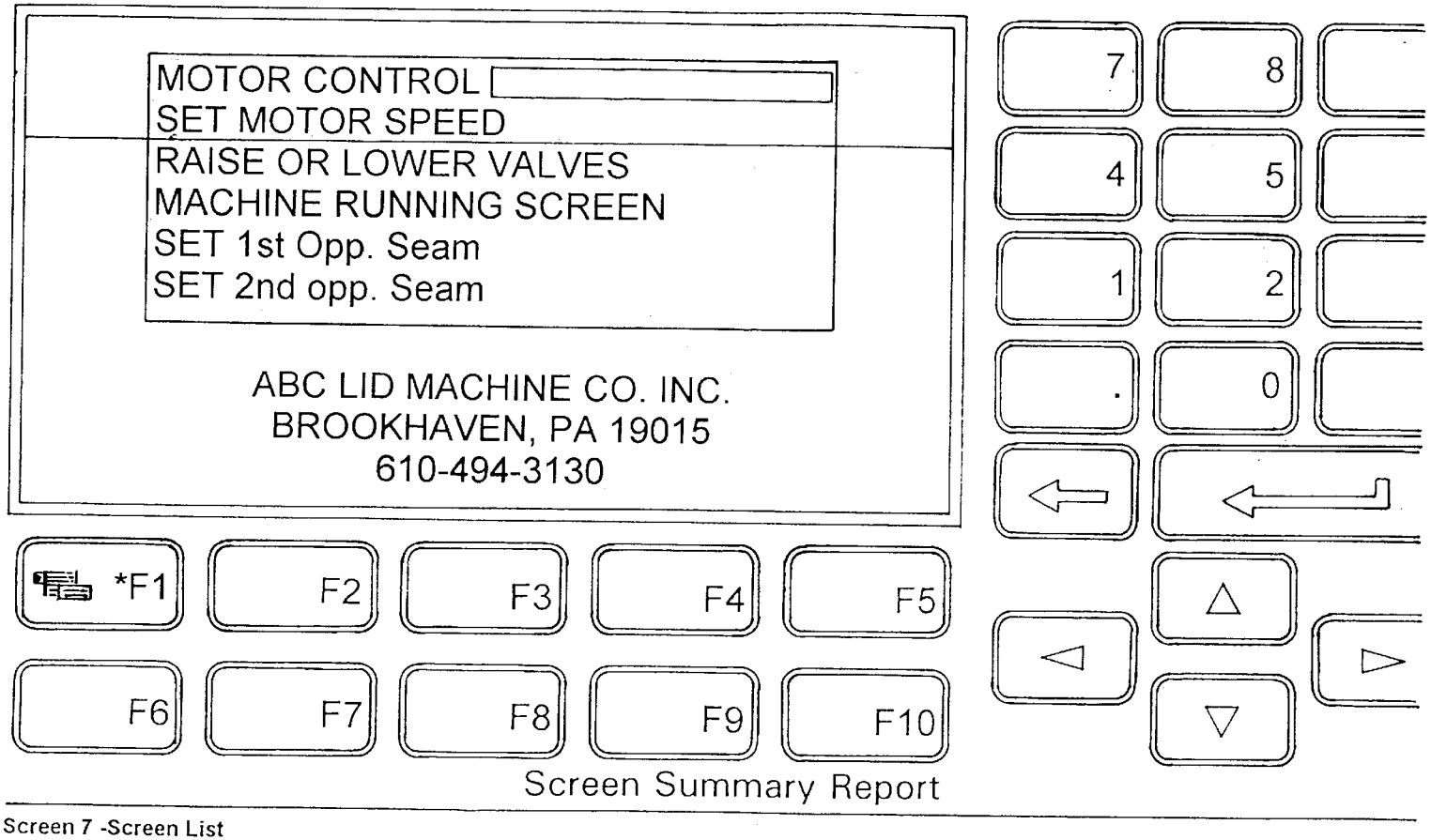
Figure 5H:
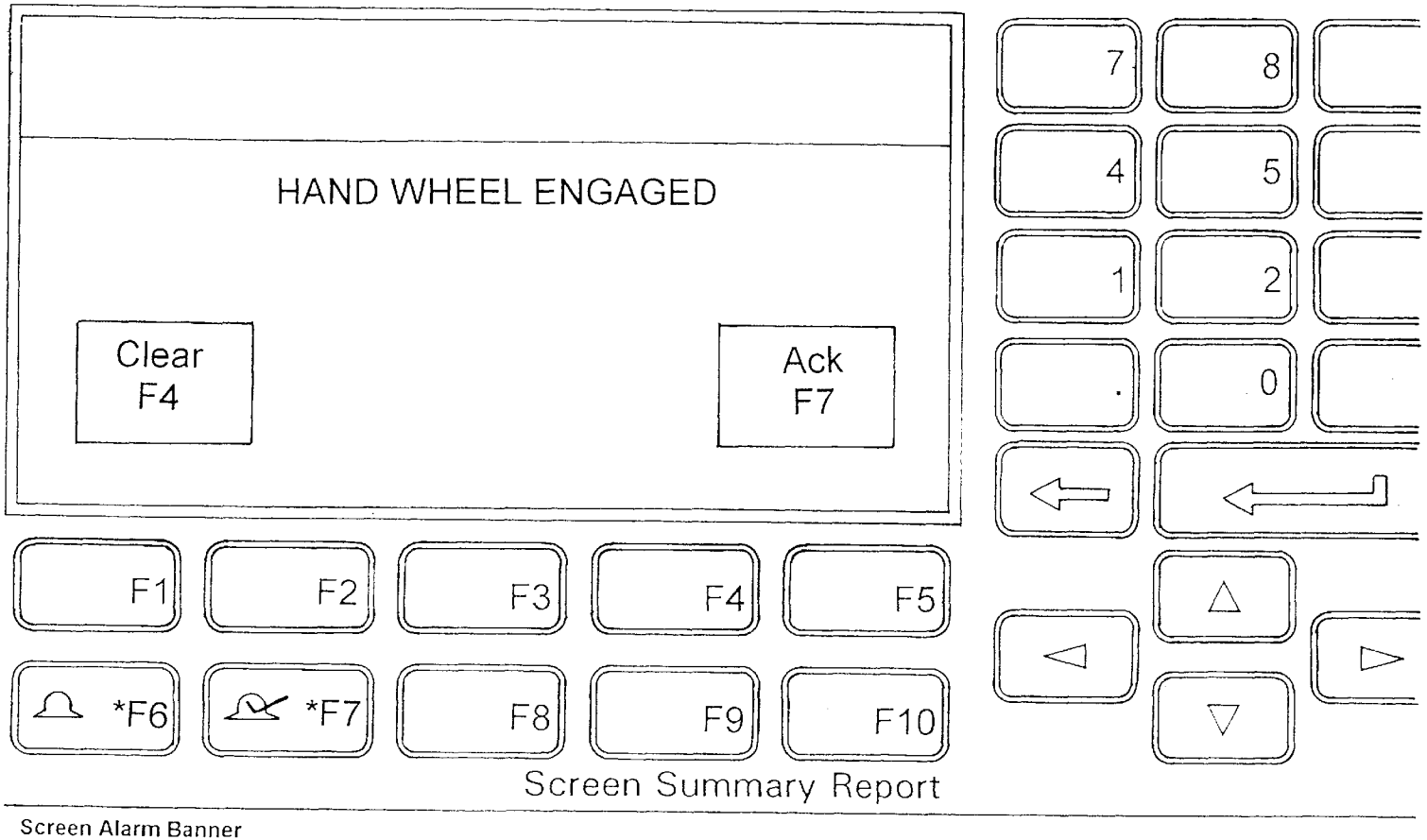

FIGS. 2–4 show detailed views of one preferred embodiment of the drive 42 and its linkages to the seaming roller 34. Referring to FIG. 2–4, the drive 42 is linked via the roll shaft 38 to the seaming roller 34. The roll shaft 38 is rotatable about its center axis $A_{rs}$. The roll shaft 38 rotates within a bushing (not shown) of a shaft housing 84. The shaft housing 84 is fixed to a housing 86 of the seaming machine 24. The drive 42 includes a servomotor 68 and a linear actuator 70. The servomotor 68 has an input for receiving control data from the programmable controller 54 related to the desired position of the seaming roller 34 with respect to the circumferential edge of the container body 12 and the container lid 16, and an output. The output of the servomotor 68 is connected to the linear actuator 70 which translates the servomotor output. The linear actuator 70 has an output shaft 72 which is pivotally connected to one end of a linking plate 74. The other end of the linking plate 74 is fixedly secured to the top surface of the roll shaft 38. Another linking plate 88 is fixedly secured at one end to the bottom surface of the roll shaft 38 and at the other end to the seaming roller 34. In this manner, movement of the output shaft 72 out of the linear actuator 70 causes rotation of the roll shaft 38 in a counterclockwise direction, which, in turn, causes the seaming roller 34 to move toward the center axis $A_{cb}$ of the container body 12. FIG. 2 shows the seaming roller 34 in contact with the circumferential edge of the lid 16 and thus in the position for performing a seaming operation. Likewise, movement of the output shaft 72 into the linear actuator 70 causes rotation of the roll shaft 38 in the clockwise direction, which, in turn, causes the seaming roller 34 to move away from the center axis $A_{cb}$ of the container body 12. During a seaming operation, the seaming roller 34 rotates about its center axis in a conventional manner.

To obtain precise control of the drive 42, the servomotor 68 is preferably a stepper motor which accepts control data from a programmable controller, and the linear actuator 70 is preferably a ball screw mechanism. Alternatively, the linear actuator 70 may be a pneumatic cylinder. Such servomotor and linear actuator combinations 68 and 70 are well-known to those skilled in the art. Accordingly, further description thereof is omitted for purposes of brevity and convenience only and is not limiting.

Poor seams are sometimes the result of insufficient or excessive force being applied between the container body 12 and the lid 16 during the seaming operation. Also, when the container bodies 12 are made of cardboard or a soft polymeric material, excessive force may cause crushing or bulging of the seamed container sidewalls. All of these problems can be minimized or eliminated by the present invention.

Referring to FIG. 1, the drive 50 associated with the base plate 48 is preferably similar to the drive 42, and thus also includes a servomotor 68 and a linear actuator 70. However, the output shaft 72 of the linear actuator 70 associated with the drive 50 is directly connected to the shaft 52 which extends from the base plate 48. The connection is along a common vertical axis. In FIG. 1, the shafts 52 and 72 appear as one continuous shaft, even though there are actually two shafts linked together. Alternatively, the shaft 52 may be eliminated, and the linear actuator's output shaft 72 may be directly connected to the base plate 48. This configuration allows for precise, computer-controlled height adjustments of the base plate 48. As a result, the drive 50 is programmable to cause varying degrees of force to be exerted between the container body 12 and the lid 16. Data obtained from the feedback sensor 64 may also be used to make fine adjustments to the final position of the base plate 48.

To obtain even better control of the force exerted between the container body 12 and the lid 16, a pressure sensor 76 may be associated within the drive 50 so that an immediate indication of the force may be detected and used for feedback control. In this scheme, a desired force is preset by the programmable controller 54. In operation, the programmable controller 54 sends instruction data to the drive 50 to cause movement of the base plate 48 toward the chuck 44. The output of the pressure sensor 76 is continuously transmitted to the programmable controller 54 and compared to the desired force. The comparison data is used to set the final position of the drive 50.

The pressure sensor 76 may be a strain gage attached to the linear actuator's output shaft 72. Alternatively, the pressure sensor 76 may be an air pressure sensor if the linear actuator 70 is a pneumatic cylinder.

Controller-driven drives provide significant advantages for the seaming machine 24, some of which are discussed below.

It is sometimes desirable to spot clinch containers during a seaming operation. Spot clinching is performed on a seaming machine by intermittently engaging and disengaging the seaming rollers from a seaming position during rotation of the seaming rollers with respect to the chuck, container body and lid. It is difficult, if not impossible, to use a conventional seaming machine for both spot clinching and complete airtight seaming. In one known technique, a rail substation is used when spot clinching with a conventional seaming machine.

The seaming machine 24 is easily adaptable to spot clinching, and to a combination of spot clinching and complete seaming operations. To perform spot clinching, it is only necessary to program the controller 54 with seaming roller engaging and disengaging instructions during rotation of the seaming chuck drive 46. For example, if four clinches are desired, the controller 54 would be programmed to engage the seaming roller 34 at 0°, 90°, 180° and 270°. Since the seaming roller 34 is controlled independent of the seaming chuck drive 46, it is not necessary to make any internal adjustments to the seaming machine 24 to perform spot clinching, to mix spot clinching and complete seaming operations in the same machine, or to perform spot clinching followed by complete seaming on the same container.

Preferred Components of Programmable Controller 54

One preferred embodiment of the present invention is implemented using an SLC 500 programmable controller, equipped with preferably two Stepper Controller Modules. The SLC 500 programmable controller and the Stepper Controller Modules are both available from Allen-Bradley, Milwaukee, Wis. The output of the Stepper Controller Module provides the control data for the respective drives. A system overview of the SLC 500 family of programmable controllers is available from Allen-Bradley and has Publication No. 1747-2.30. A User's Manual for the Stepper Controller Module is available from Allen-Bradley and has Catalog No. 1746-HSTP1. Alternatively, one or three or more Stepper Controller Modules may be used, depending upon the needs of the overall system.

One preferred configuration of the SLC 500 programmable controller has the following components:

SLC 500 Modular Controller with an SLC 5/03 processor.

Memory Module—Catalog No. 1747-M1 12K Words

Power Supply—Catalog No. 1746-P2

24 VDC, 16 input Discrete Input Module—Catalog No. 1746-IV16

120/240 VAC, 16 output Discrete Output Module—Catalog No. 1746-OA16

VAC/VDC Relay, 16 output Discrete Output Module—Catalog No. 1746-OW16

I/O Analog Module—NIO4I and NIO4V

Operator Terminal—2711 PanelView 550 Operator Terminal,
Panelbuilder 550 Software Remote communication module—1746-BAS Basic Module or 1747-KE Interface Module The 1746-BAS Basic Module provides limited remote capability. The 1747-KE Interface Module provides full remote capability so that all of the functions of the programmable controller 54, including the functions of adjusting drive instructions based on sensed container types and seam feedback data, can be performed remotely.

A sample ladder diagram for implementing seaming machine control via the Stepper Controller Module is shown in the Appendix. The ladder diagram performs the following machine control functions:

1. Configure the Stepper Controller Modules.
2. Start, stop and jog the seaming machine 24 (sends signal to AC motor inverter, also controls machine speed). This function also includes controlling power to the chuck drive 46 and the feed valves 26 and 28.
3. Synchronize machine speeds and stepper motors.
4. Provide safety stops to protect machinery.
5. Track production and machine running hours.
6. Provide an interface with PanelView 550 Operator Terminal to allow for seaming roll adjustments.
7. Provide circuitry to allow valves to be raised and lowered for cleaning and maintenance.

Referring to function 2 above, the chuck drive 46 may also be controlled by a stepper motor which would require more precise control signals than power on/off signals used in the present embodiment of the invention.

Sample PanelView 550 display screens and their respective screen summary reports are shown in FIGS. 5A–5H. These display screens may be generated using a PV550 Keypad and Touch Screen with software version FRN 2.00-2.xx, available as Allen-Bradley Catalog Part no. 2711-B5A3.

Components of Drives 40, 42, 50

One family of drives which are suitable for use as the drives 40, 42 and 50 are the ET Series Electro-Thrust Electric Cylinder, available from Parker Motion & Control, Parker Hannifin Corporation, Automation Actuator Division, Wadsworth, Ohio. Each of these drives have a ball screw and a stepper motor.

Rotations for Seaming Operation

One preferred embodiment of the invention requires a total of five container revolutions to seam a container, 2½ revolutions for the first (initial) seam and 2½ revolutions for the second (final) seam. The precise number of revolutions depends upon a myriad of factors, including the desired properties of the containers and the seams.

Liquid Nitrogen Injection

Many types of containers are seamed under vacuum so that the container interiors have substantially no air after they are seamed. In this manner, the container contents cannot become spoiled by exposure to oxygen in air trapped in the sealed container. Nuts are one product which is easily spoiled by exposure to oxygen. Seaming machines which operate in a vacuum environment, such as the seaming machine of FIG. 1, are complex, expensive, and difficult to operate, compared to seaming machines which do not operate in a vacuum environment.

One technique that has been developed to avoid having to seam in a vacuum environment while still obtaining a substantially air-free container interior, is a liquid nitrogen injection process. In this process, a container body having a sealed bottom is filled with contents. Liquid nitrogen is then injected into the open top of a container body. The liquid nitrogen immediately begins to vaporize and drives out substantially all of the air (and thus substantially all of the oxygen) from the container body. The container body is then covered by a lid which may have a removable center foil seal, and the lidded container body is delivered to a seaming machine which seams the lid to the container body.

The conventional liquid nitrogen injection process suffers from many problems. One problem is that it is difficult to properly time the process so that at the exact time when the lid is seamed to the container body, (1) substantially all of the air has been displaced so that the sealed container has less than about 2% oxygen, (2) all of the liquid nitrogen has vaporized, and (3) no surrounding air has flowed back into the container body. Referring to condition (1), if substantially all of the air is not displaced, the seamed container will have significant quantities of oxygen trapped therein which will accelerate spoilage of the contents. Referring to condition (2), if all of the liquid nitrogen is not displaced when the container is seamed, the vaporized nitrogen gas from the remaining liquid nitrogen will become trapped inside the container and will cause the container to visibly bulge. Consumers will not purchase visibly bulging containers, assuming that the contents are spoiled or defective. Referring to condition (3), if the container body is not seamed immediately after all of the liquid nitrogen has vaporized, the surrounding air will start to flow back into the container, thereby displacing a portion of the nitrogen gas. The resultant seamed container will contain a significant quantity of oxygen which will accelerate spoilage of the contents.

Another problem with the conventional liquid nitrogen injection process is that it is very wasteful of liquid nitrogen, primarily because the vaporization and air displacement process occurs in an open environment (i.e., no lid is on the container body).

Figure 6:
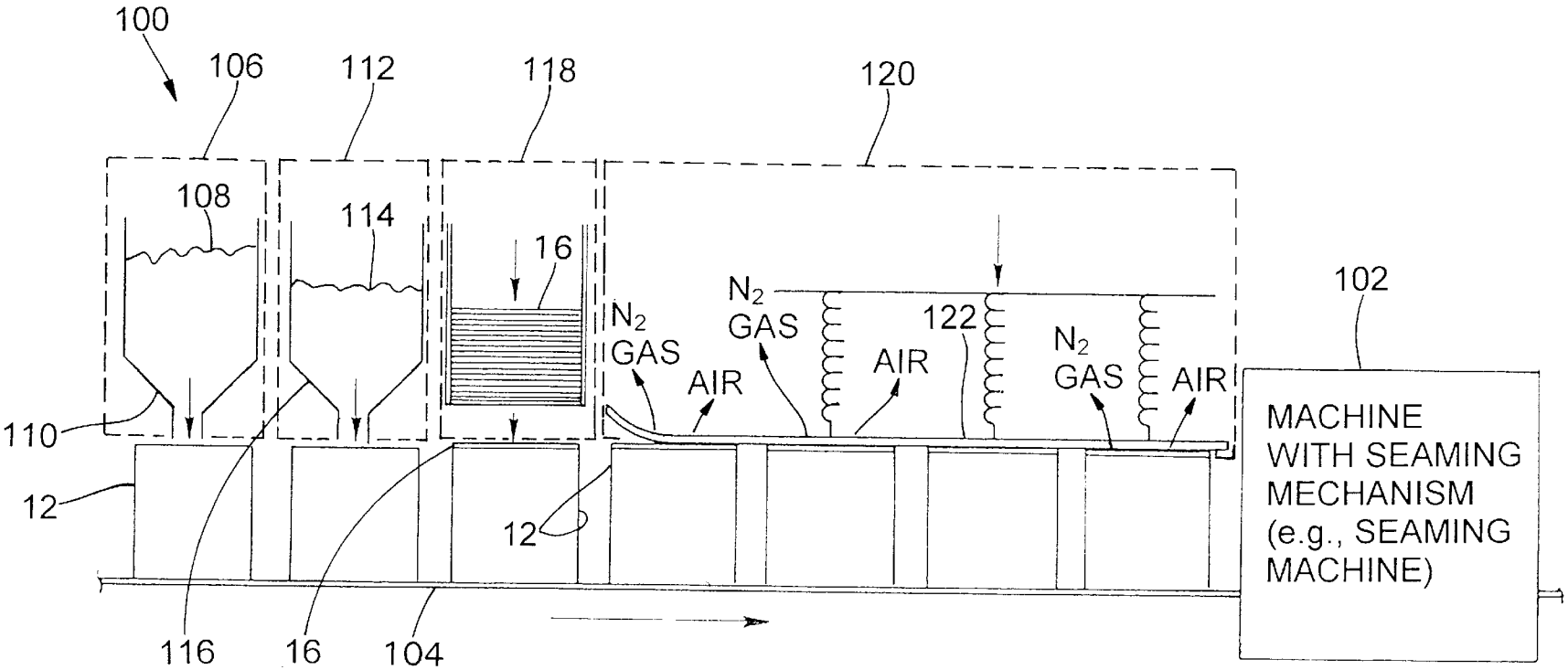
FIG. 6 is a schematic illustration of an assembly line process for removing air from containers prior to seaming the containers, in accordance with the present invention.

FIG. 6 shows an assembly line process 100 which uses liquid nitrogen injection in accordance with the present invention to pack goods in seamed containers. Each container has a container body 12 and a lid 16 which are seamed together by a seaming mechanism of a machine 102 (typically, a seaming machine) located at the end of assembly line process 100. Each container body 12 has a sealed bottom and an open top as it enters a conveyer 104 which moves the container body 12 through the assembly line process 100. The assembly line process 100 comprises the following sequential steps which are applied to a succession of container bodies 12:

(1) At a first station 106, each container body 12 is filled with a predetermined quantity of goods 108 dispensed from a storage bin 110. The storage bin 110 is illustrated in FIG. 6 as a hopper, but may be any type of storage facility which has a dispensing passage.

(2) At a second station 112, each goods filled container body 12 is injected with a predetermined amount of liquid nitrogen 114 dispensed from a holding tank 116. The predetermined amount of liquid nitrogen 114 is an amount which is sufficient to displace substantially all of the air which is originally in the container body 12.

(3) At a third station 118, the open top of each container body 12 is covered with a lid 16.

(4) After each container body 12 exits the third station 118, a lid holder 120 applies a biasing force against the lids 16 to maintain the lids 16 on the container bodies 12 until they reach the seaming mechanism of the machine 102. One suitable lid holder 120 is a spring loaded guide rail 122 which simultaneously applies the biasing force to all lidded container bodies 12 traveling along the conveyer 104. The biasing force is sufficient to allow a portion of nitrogen gas from vaporization of the liquid nitrogen, as well as air originally present in the container body 12, to escape from the container body, while preventing surrounding air from entering the container body 12. The lid holder 120 thus allows each of the lids 16 to act as a check valve for its respective container body 12. In one suitable embodiment of the invention, the biasing force is no more than about three pounds of spring pressure on each container body 12. The biasing force is selected to prevent the lid 16 from raising more than about ⅛ inches off the top of the container body 12 for a typical lid which has a vertical thickness of about ¼ inch.

Steps (3) and (4) are preferably performed in rapid succession and immediately after step (2). In this manner, the amount of liquid nitrogen 114 used in the process 100 is kept to a minimum because almost all of the vaporizing liquid nitrogen 114 is used to expel air trapped inside the lidded container body 12.

Step (4) is performed for a period of time sufficient to allow substantially all of the liquid nitrogen 114 trapped within the container body 12 to vaporize, and thereby displace substantially all of the air originally present therein. Since the lids 16 act as check valves, there is no harm in exceeding this period of time. That is, as long as the biasing force continues to be applied, no air can reenter the lidded (but unseamed) container bodies 12. As discussed above, a conventional liquid nitrogen filling process requires precise control between the time when liquid nitrogen is injected into the container body and the time when the seaming process occurs because air is free to flow back into the container body if all of the liquid nitrogen vaporizes before the container body has reached the seaming mechanism, and because a bulge may form in a container if the container body is seamed before all of the liquid nitrogen has vaporized. By freeing the process from the need for tight timing control, it is possible to improve the final results of the process (e.g., less bulging containers, less likelihood of high oxygen levels), while reducing its complexity.

Furthermore, the process 100 requires substantially less liquid nitrogen than conventional filling processes. A conventional filling process typically calls for filling container bodies with substantially more liquid nitrogen than is necessary to displace the air therein because the vaporization and air displacement occurs in an open environment (i.e., no lid). Accordingly, much of the nitrogen gas escapes from the container body throughout the displacement process. Also, ambient air constantly enters the container body throughout the displacement process, thereby adding to the total amount of ambient air that must be displaced. To compensate for these two factors, a significant quantity of extra liquid nitrogen must be injected to ensure that there is a sufficient amount of vaporizing liquid nitrogen so that the resultant sealed container has less than about 2% oxygen. In contrast to conventional liquid nitrogen filling processes, the amount of liquid nitrogen 114 required by the process 100 of FIG. 6 is an amount which is only slightly greater than the amount sufficient to displace substantially all of the air which is originally in the container body 12. The amount must be slightly greater to account for some leakage as the container bodies travel between the second station 112 and the third station 114, and between the third station 114 and the lid holder 120.

An alternative embodiment of FIG. 6 may use a clincher as the lid holder 120. The force applied by the clincher would meet the same criteria as the force applied by the spring loaded guide rail 122 discussed above.

To further enhance the efficiency of the process 100, the container bodies 12 may optionally be heated from below during step (4) to drive out (i.e., vaporize) all of the liquid nitrogen 114.

The preferred embodiment of the invention uses liquid nitrogen as the oxygen displacing gas. However, the scope of the invention includes processes which use other inert gases in place of some or all of the liquid nitrogen.

Retrofit of Conventional Seaming Machine

The present invention is preferably implemented by designing a seaming machine which has independently controlled drives for the seaming chuck and for the seaming rollers. However, the scope of the invention also includes conventional seaming machines (both vacuum and non-vacuum environment machines) which are retrofitted with independently controllable drives.

A conventional seaming machine has a single motor, but two power takeoffs, one for the drive which rotates the seaming roller with respect to the chuck, and one for the drive(s) which control the position of the seaming rollers with respect to a circumferential edge of the lid. In one suitable retrofit method, the drive which rotates the seaming roller with respect to the chuck becomes directly controlled by the programmable controller 54, and new drives (which are also directly controlled by the programmable controller 54) are installed to control the position of the seaming rollers with respect to a circumferential edge of the lid. Alternatively, a new drive is also installed to rotates the seaming roller with respect to the chuck. In addition, another drive (also directly controlled by the programmable controller 54) is installed to control container body lifting, if precise control of the lifting process is desired.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

APPENDIX
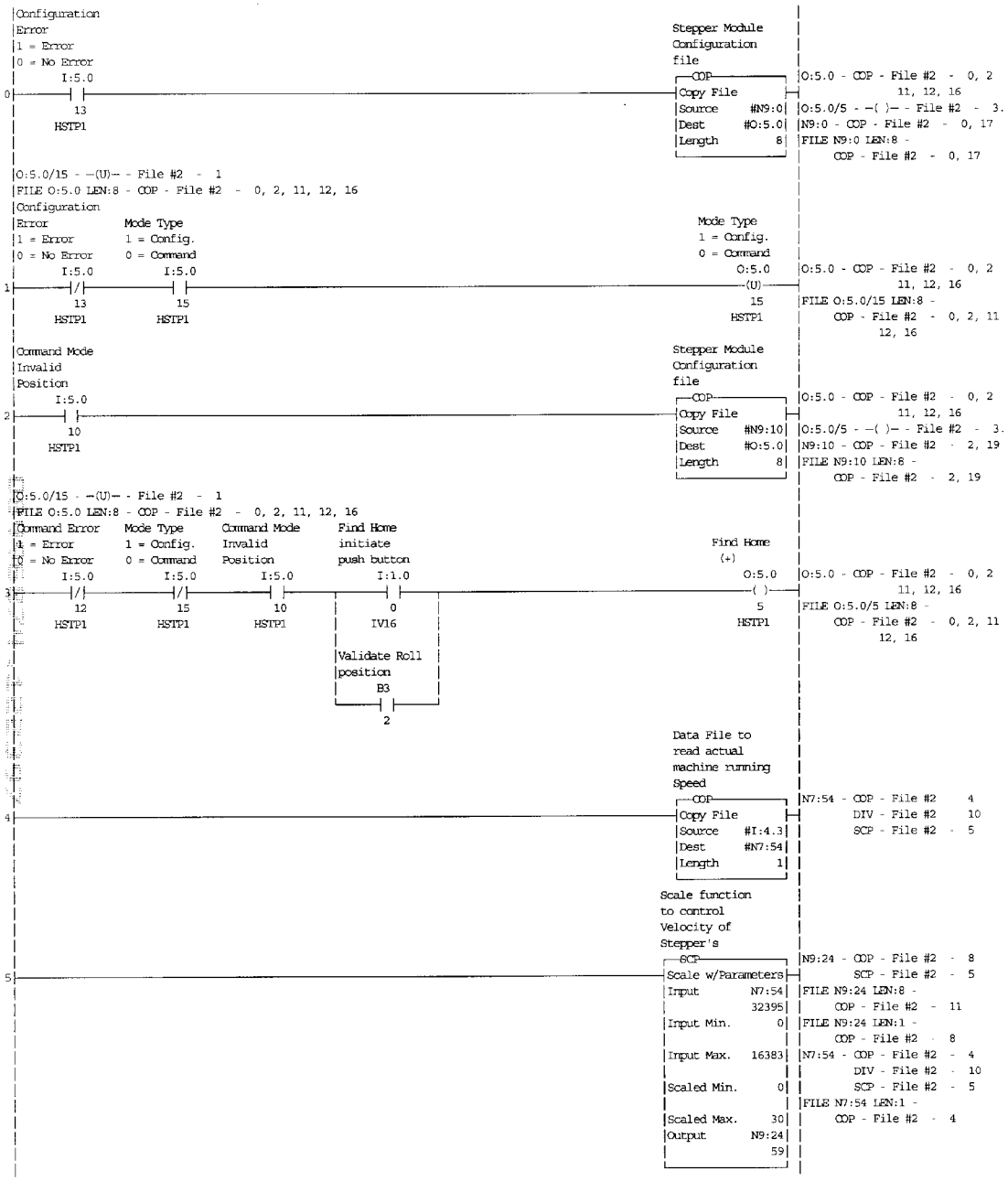

```
Start First
Opperation
Seam
Prox.
      I:1.0
6 ----|/|-------------------------------------------------------------
        3
     IV16

                                                   Speed
                                                   For Accel.
                                                   Time on the
                                                   Stepper Modules
                                                   ┌─CPT──────────────────┐
                                                   │Compute               │
                                                   │Dest            N9:26 │
                                                   │                  776 │
                                                   │Expression            │
                                                   │   (0.086 * (N7:2 ** 2.0)) -│
                                                   │                0.387 │
                                                   └──────────────────────┘

N9:26 - COP - File #2  -  9
Speed Scalling
For Accel.
Time on the
Stepper Modules
┌─LEQ──────────────────┐
7 │Less Than or Eql (A<=B)│
  │Source A        N9:26 │
  │                  776 │
  │Source B            1 │
  └──────────────────────┘
N9:26 - [7]

                                                   Speed Scalling
                                                   For Accel.
                                                   Time on the
                                                   Stepper Modules
                                                   ┌─MOV──────────────────┐
                                                   │Move                  │
                                                   │Source              1 │
                                                   │                      │
                                                   │Dest            N9:26 │
                                                   │                  776 │
                                                   └──────────────────────┘

                                                   send velocity
                                                   setting to
                                                   Stepper Modules
8 ------------------------------------------------------------------
                                                   ┌─COP──────────────────┐
                                                   │Copy File             │
                                                   │Source     #N9:24     │
                                                   │Dest       #N9:34     │
                                                   │Length              1 │
                                                   └──────────────────────┘
                                                   Velocity for
                                                   2nd opperation
                                                   Stepper
                                                   ┌─COP──────────────────┐
                                                   │Copy File             │
                                                   │Source     #N9:24     │
                                                   │Dest       #N9:54     │
                                                   │Length              1 │
                                                   └──────────────────────┘
                                                   ┌─COP──────────────────┐
                                                   │Copy File             │
                                                   │Source     #N9:24     │
                                                   │Dest       #N9:64     │
                                                   │Length              1 │
                                                   └──────────────────────┘
                                                   1st opperation
                                                   out¶ dir¶c¶
9 ------------------------------------------------------------------
                                                   ┌─COP──────────────────┐
                                                   │Copy File             │
                                                   │Source     #N9:26     │
                                                   │Dest       #N9:36     │
                                                   │Length              1 │
                                                   └──────────────────────┘
                                                   Acceleration
                                                   Setting for 2nd
                                                   Opperation
                                                   Stepper Module
                                                   ┌─COP──────────────────┐
                                                   │Copy File             │
                                                   │Source     #N9:26     │
                                                   │Dest       #N9:56     │
                                                   │Length              1 │
                                                   └──────────────────────┘
                                                   ┌─COP──────────────────┐
                                                   │Copy File             │
                                                   │Source     #N9:26     │
                                                   │Dest       #N9:66     │
                                                   │Length              1 │
                                                   └──────────────────────┘

N9:26 - MOV - File #2  -  7
        COP - File #2  -  9
        LEQ - File #2  -  7
        CPT - File #2  -  6
FILE N9:26 LEN:8 -
     COP - File #2  -  11
N7:2 - DIV - File #2  -  10
       CPT - File #2  -  6

N9:26 - MOV - File #2  -  7
        COP - File #2  -  9
        LEQ - File #2  -  7
        CPT - File #2  -  6
FILE N9:26 LEN:8 -
     COP - File #2  -  11
FILE N9:26 LEN:1 -
     COP - File #2  -  9

FILE N9:34 LEN:8 -
     COP - File #2  -  12
N9:24 - COP - File #2  -  8
        SCP - File #2  -  5
FILE N9:24 LEN:8 -
     COP - File #2  -  11

FILE N9:54 LEN:8 -
     COP - File #2  -  21

FILE N9:64 LEN:8 -
     COP - File #2  -  23

FILE N9:36 LEN:8 -
     COP - File #2  -  12
N9:26 - MOV - File #2  -  7
        COP - File #2  -  9
        LEQ - File #2  -  7
        CPT - File #2  -  6
FILE N9:26 LEN:8 -
     COP - File #2  -  11

FILE N9:56 LEN:8 -
     COP - File #2  -  21

FILE N9:66 LEN:8 -
     COP - File #2  -  23
```

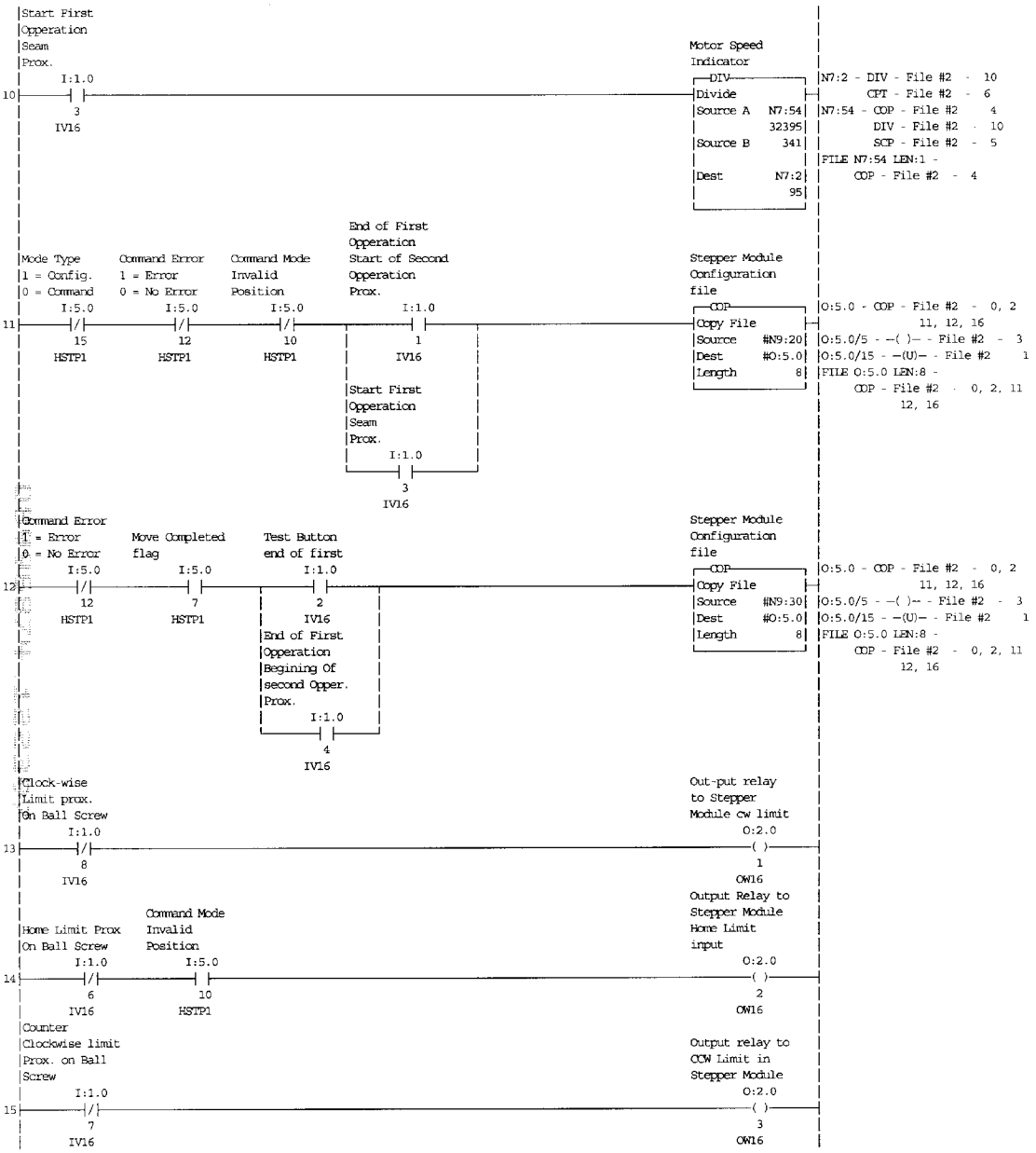
Start First Opperation Seam Prox.
I:1.0
3
IV16
Motor Speed Indicator
DIV
Divide
Source A N7:54
32395
Source B 341
Dest N7:2
95
N7:2 - DIV - File #2 - 10
CPT - File #2 - 6
N7:54 - COP - File #2 4
DIV - File #2 - 10
SCP - File #2 - 5
FILE N7:54 LEN:1 -
COP - File #2 - 4
Mode Type
1 = Config.
0 = Command
I:5.0
15
HSTP1
Command Error
1 = Error
0 = No Error
I:5.0
12
HSTP1
Command Mode Invalid Position
I:5.0
10
HSTP1
End of First Opperation Start of Second Opperation Prox.
I:1.0
1
IV16
Start First Opperation Seam Prox.
I:1.0
3
IV16
Stepper Module Configuration file
COP
Copy File
Source #N9:20
Dest #O:5.0
Length 8
O:5.0 - COP - File #2 - 0, 2
11, 12, 16
O:5.0/5 - -( )- - File #2 - 3
O:5.0/15 - -(U)- - File #2 1
FILE O:5.0 LEN:8 -
COP - File #2 - 0, 2, 11
12, 16
Command Error
1 = Error
0 = No Error
I:5.0
12
HSTP1
Move Completed flag
I:5.0
7
HSTP1
Test Button end of first
I:1.0
2
IV16
End of First Opperation Begining Of second Opper. Prox.
I:1.0
4
IV16
Stepper Module Configuration file
COP
Copy File
Source #N9:30
Dest #O:5.0
Length 8
O:5.0 - COP - File #2 - 0, 2
11, 12, 16
O:5.0/5 - -( )- - File #2 - 3
O:5.0/15 - -(U)- - File #2 1
FILE O:5.0 LEN:8 -
COP - File #2 - 0, 2, 11
12, 16
Clock-wise Limit prox. On Ball Screw
I:1.0
8
IV16
Out-put relay to Stepper Module cw limit
O:2.0
1
OW16
Home Limit Prox On Ball Screw
I:1.0
6
IV16
Command Mode Invalid Position
I:5.0
10
HSTP1
Output Relay to Stepper Module Home Limit input
O:2.0
2
OW16
Counter Clockwise limit Prox. on Ball Screw
I:1.0
7
IV16
Output relay to CCW Limit in Stepper Module
O:2.0
3
OW16

```
|Command Error                                                                  Stepper Module
|1 = Error                                                                      Configuration
|0 = No Error                                                                   file
|      I:5.0                                                                    ┌─COP──────────┐
16├──────┤ ├──────────────────────────────────────────────────────────────────│Copy File     ├─┤ |O:5.0 - COP - File #2 - 0, 2
|        12                                                                    |Source   #N9:40| |              11, 12, 16
|     HSTP1                                                                    |Dest     #O:5.0| |O:5.0/5 - -( )- - File #2 - 3.
|                                                                              |Length       8| |N9:40 - COP - File #2 - 16, 27
|                                                                              └──────────────┘ |FILE N9:40 LEN:8 -
|                                                                                               |    COP - File #2 - 16, 27
|O:5.0/15 - -(U)- - File #2 - 1                                                                |
|FILE O:5.0 LEN:8 - COP - File #2 - 0, 2, 11, 12, 16                                           |
|2nd opperation                                                                                |
|stepper Module                                                                                |
|config. Error                                                                  Second Stepper
|1 = Error                                                                      Module Config.
|0 = No Error                                                                   file
|      I:6.0                                                                    ┌─COP──────────┐
17├──────┤ ├──────────────────────────────────────────────────────────────────│Copy File     ├─┤ |O:6.0 - COP - File #2 - 17, 19
|        13                                                                    |Source   #N9:0 | |              21, 23, 27
|     HSTP1                                                                    |Dest     #O:6.0| |O:6.0/5 - -( )- - File #2 - 20
|                                                                              |Length       8| |N9:0 - COP - File #2 - 0, 17
|                                                                              └──────────────┘ |FILE N9:0 LEN:8 -
|                                                                                               |    COP - File #2    0, 17
|O:6.0/15 - -(U)- - File #2 - 18                                                               |
|FILE O:6.0 LEN:8 - COP - File #2 - 17, 19, 21, 23, 27                                         |
|2nd opperation    2nd opperation                                              2nd Opperation
|stepper Module    Stepper Module                                              stepper Module
|config. Error     Mode Type                                                   Mode Type
|1 = Error         1 = Config.                                                 1 = Config.
|0 = No Error      0 = Command                                                 0 = Command
|      I:6.0            I:6.0                                                        O:6.0 |O:6.0 - COP - File #2 - 17, 19
18├──────┤/├──────────────┤ ├──────────────────────────────────────────────────────(U)──┤              21, 23, 27
|        13             15                                                          15 |FILE O:6.0/15 LEN:8 -
|     HSTP1          HSTP1                                                        HSTP1 |    COP - File #2    17, 19
|                                                                                        |          21, 23, 27
|2nd Opperation                                                                          |
|Stepper Module                                                                          |
|Command Mode                                                                   Second Stepper
|Invalid                                                                        Module Config.
|Position                                                                       file
|      I:6.0                                                                    ┌─COP──────────┐
19├──────┤ ├──────────────────────────────────────────────────────────────────│Copy File     ├─┤ |O:6.0 - COP - File #2 - 17, 19
|        10                                                                    |Source   #N9:10| |              21, 23, 27
|     HSTP1                                                                    |Dest     #O:6.0| |O:6.0/5 - -( )- - File #2 - 20
|                                                                              |Length       8| |N9:10 - COP - File #2 - 2, 19
|                                                                              └──────────────┘ |FILE N9:10 LEN:8 -
|                                                                                               |    COP - File #2 - 2, 19
|O:6.0/15 - -(U)- - File #2 - 18                                                               |
|FILE O:6.0 LEN:8 - COP - File #2 - 17, 19, 21, 23, 27                                         |
|2nd Opperation    2nd opperation    2nd Opperation                                            |
|Stepper Module    Stepper Module    Stepper Module                                            |
|command Error     Mode Type         Command Mode                                              |
|1 = Error         1 = Config.       Invalid                Find Home                          2nd Opperation
|0 = No Error      0 = Command       Position               initiate                           Stepper Module
|      I:6.0            I:6.0             I:6.0                push button                        Find Home (+)
|                                                                  I:1.0                            O:6.0 |O:6.0 - COP - File #2 - 17, 19
20├──────┤/├──────────────┤/├──────────────┤ ├──────────┬──────┤ ├──────────────────────────────( )──┤              21, 23, 27
|        12             15             10 |        0   |                                          5 |FILE O:6.0/5 LEN:8 -
|     HSTP1          HSTP1          HSTP1 |      IV16  |                                       HSTP1 |    COP - File #2 - 17, 19
|                                          |            |                                             |          21, 23, 27
|                                          |Validate Roll |                                           |
|                                          |position    |                                           |
|                                          |      B3    |                                           |
|                                          └──────┤ ├────┘                                           |
|                                                 2                                                  |
|2nd opperation    2nd Opperation    2nd Opperation    End of First                               |
|Stepper Module    Stepper Module    Stepper Module    Opperation                                 |
|Mode Type         command Error     Command Mode      Begining Of                                Second Stepper
|1 = Config.       1 = Error         Invalid           second Opper.    2nd Opperation            Module Config.
|0 = Command       0 = No Error      Position          Prox.            No Seam Relay             file
|      I:6.0            I:6.0             I:6.0             I:1.0            B3                    ┌─COP──────────┐
21├──────┤/├──────────────┤/├──────────────┤/├──────────────┤ ├──────────────┤/├──────────────────│Copy File     ├─┤ |O:6.0 - COP - File #2 - 17, 19
|        15             12             10             4             25                            |Source   #N9:50| |              21, 23, 27
|     HSTP1          HSTP1          HSTP1          IV16          [22]                            |Dest     #O:6.0| |O:6.0/5 - -( )- - File #2 - 20
|                                                                                                 |Length       8| |O:6.0/15 - -(U)- - File #2
|                                                                                                 └──────────────┘ |                18
|                                                                                                                  |FILE O:6.0 LEN:8 -          ...
|O:6.0 - COP File #2 - 17, 19, 21, 23, 27                                                          |
```

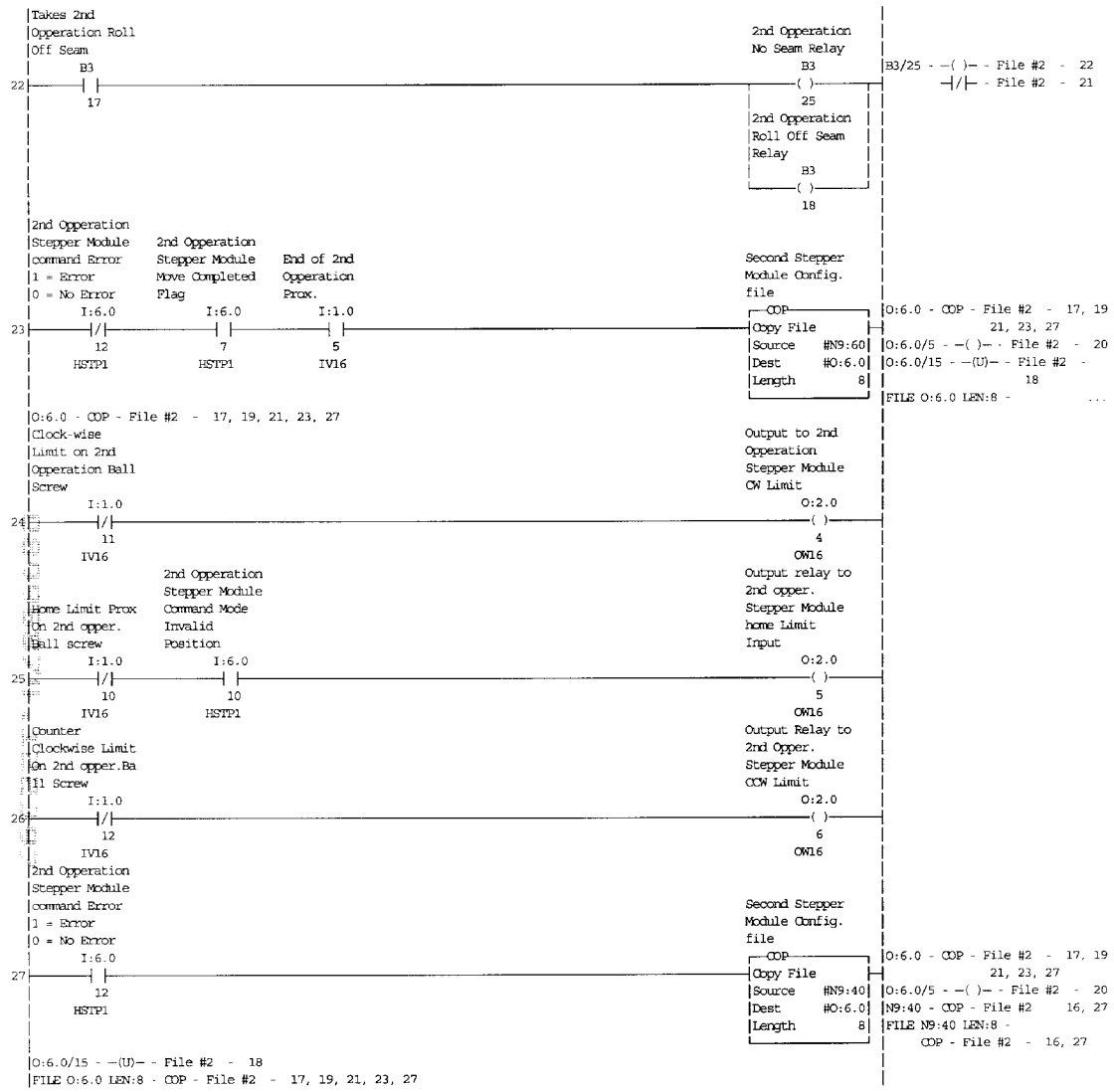
Takes 2nd Opperation Roll Off Seam
B3
17
2nd Opperation No Seam Relay
B3
25
2nd Opperation Roll Off Seam Relay
B3
18
B3/25 - -( )- - File #2 - 22
-|/|- - File #2 - 21
2nd Opperation Stepper Module command Error 1 = Error 0 = No Error
I:6.0
12
HSTP1
2nd Opperation Stepper Module Move Completed Flag
I:6.0
7
HSTP1
End of 2nd Opperation Prox.
I:1.0
5
IV16
Second Stepper Module Config. file
COP
Copy File
Source #N9:60
Dest #O:6.0
Length 8
O:6.0 - COP - File #2 - 17, 19 21, 23, 27
O:6.0/5 - -( )- - File #2 - 20
O:6.0/15 - -(U)- - File #2 - 18
FILE O:6.0 LEN:8 -
O:6.0 - COP - File #2 - 17, 19, 21, 23, 27
Clock-wise Limit on 2nd Opperation Ball Screw
I:1.0
11
IV16
Output to 2nd Opperation Stepper Module CW Limit
O:2.0
4
OW16
Home Limit Prox On 2nd opper. Ball screw
I:1.0
10
IV16
2nd Opperation Stepper Module Command Mode Invalid Position
I:6.0
10
HSTP1
Output relay to 2nd opper. Stepper Module home Limit Input
O:2.0
5
OW16
Counter Clockwise Limit On 2nd opper.Ball Screw
I:1.0
12
IV16
Output Relay to 2nd Opper. Stepper Module CCW Limit
O:2.0
6
OW16
2nd Opperation Stepper Module command Error 1 = Error 0 = No Error
I:6.0
12
HSTP1
Second Stepper Module Config. file
COP
Copy File
Source #N9:40
Dest #O:6.0
Length 8
O:6.0 - COP - File #2 - 17, 19 21, 23, 27
O:6.0/5 - -( )- - File #2 - 20
N9:40 - COP - File #2 16, 27
FILE N9:40 LEN:8 -
COP - File #2 - 16, 27
O:6.0/15 - -(U)- - File #2 - 18
FILE O:6.0 LEN:8 - COP - File #2 - 17, 19, 21, 23, 27

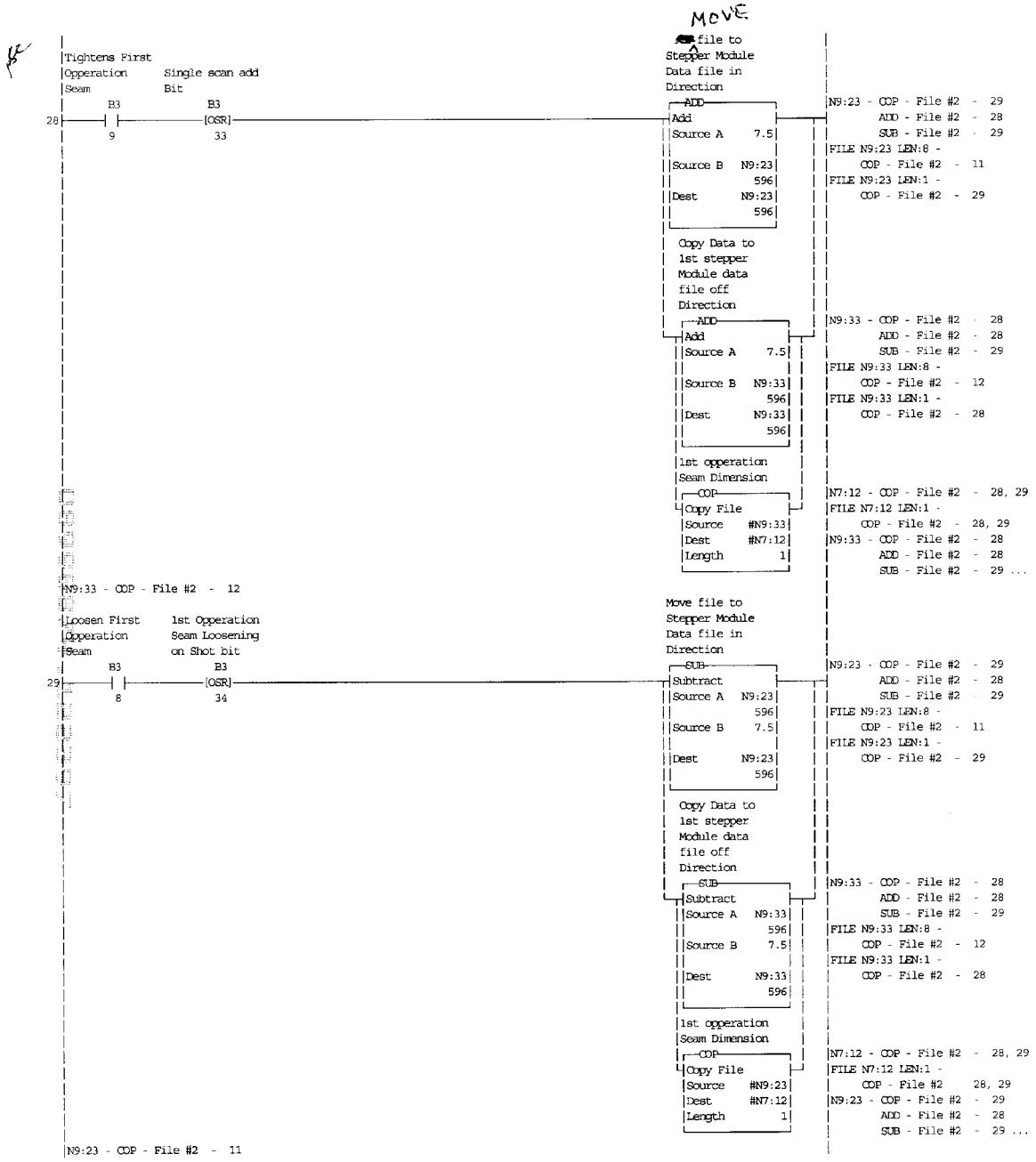
MOVE
Tightens First
Opperation
Seam
Single scan add
Bit
B3
9
B3
33
OSR
28
file to
Stepper Module
Data file in
Direction
ADD
Add
Source A 7.5
Source B N9:23
596
Dest N9:23
596
N9:23 - COP - File #2 - 29
ADD - File #2 - 28
SUB - File #2 - 29
FILE N9:23 LEN:8 -
COP - File #2 - 11
FILE N9:23 LEN:1 -
COP - File #2 - 29
Copy Data to
1st stepper
Module data
file off
Direction
ADD
Add
Source A 7.5
Source B N9:33
596
Dest N9:33
596
N9:33 - COP - File #2 - 28
ADD - File #2 - 28
SUB - File #2 - 29
FILE N9:33 LEN:8 -
COP - File #2 - 12
FILE N9:33 LEN:1 -
COP - File #2 - 28
1st opperation
Seam Dimension
COP
Copy File
Source #N9:33
Dest #N7:12
Length 1
N7:12 - COP - File #2 - 28, 29
FILE N7:12 LEN:1 -
COP - File #2 - 28, 29
N9:33 - COP - File #2 - 28
ADD - File #2 - 28
SUB - File #2 - 29 ...
N9:33 - COP - File #2 - 12
Loosen First
Opperation
Seam
1st Opperation
Seam Loosening
on Shot bit
B3
8
B3
34
OSR
29
Move file to
Stepper Module
Data file in
Direction
SUB
Subtract
Source A N9:23
596
Source B 7.5
Dest N9:23
596
N9:23 - COP - File #2 - 29
ADD - File #2 - 28
SUB - File #2 - 29
FILE N9:23 LEN:8 -
COP - File #2 - 11
FILE N9:23 LEN:1 -
COP - File #2 - 29
Copy Data to
1st stepper
Module data
file off
Direction
SUB
Subtract
Source A N9:33
596
Source B 7.5
Dest N9:33
596
N9:33 - COP - File #2 - 28
ADD - File #2 - 28
SUB - File #2 - 29
FILE N9:33 LEN:8 -
COP - File #2 - 12
FILE N9:33 LEN:1 -
COP - File #2 - 28
1st opperation
Seam Dimension
COP
Copy File
Source #N9:23
Dest #N7:12
Length 1
N7:12 - COP - File #2 - 28, 29
FILE N7:12 LEN:1 -
COP - File #2 28, 29
N9:23 - COP - File #2 - 29
ADD - File #2 - 28
SUB - File #2 - 29 ...
N9:23 - COP - File #2 - 11

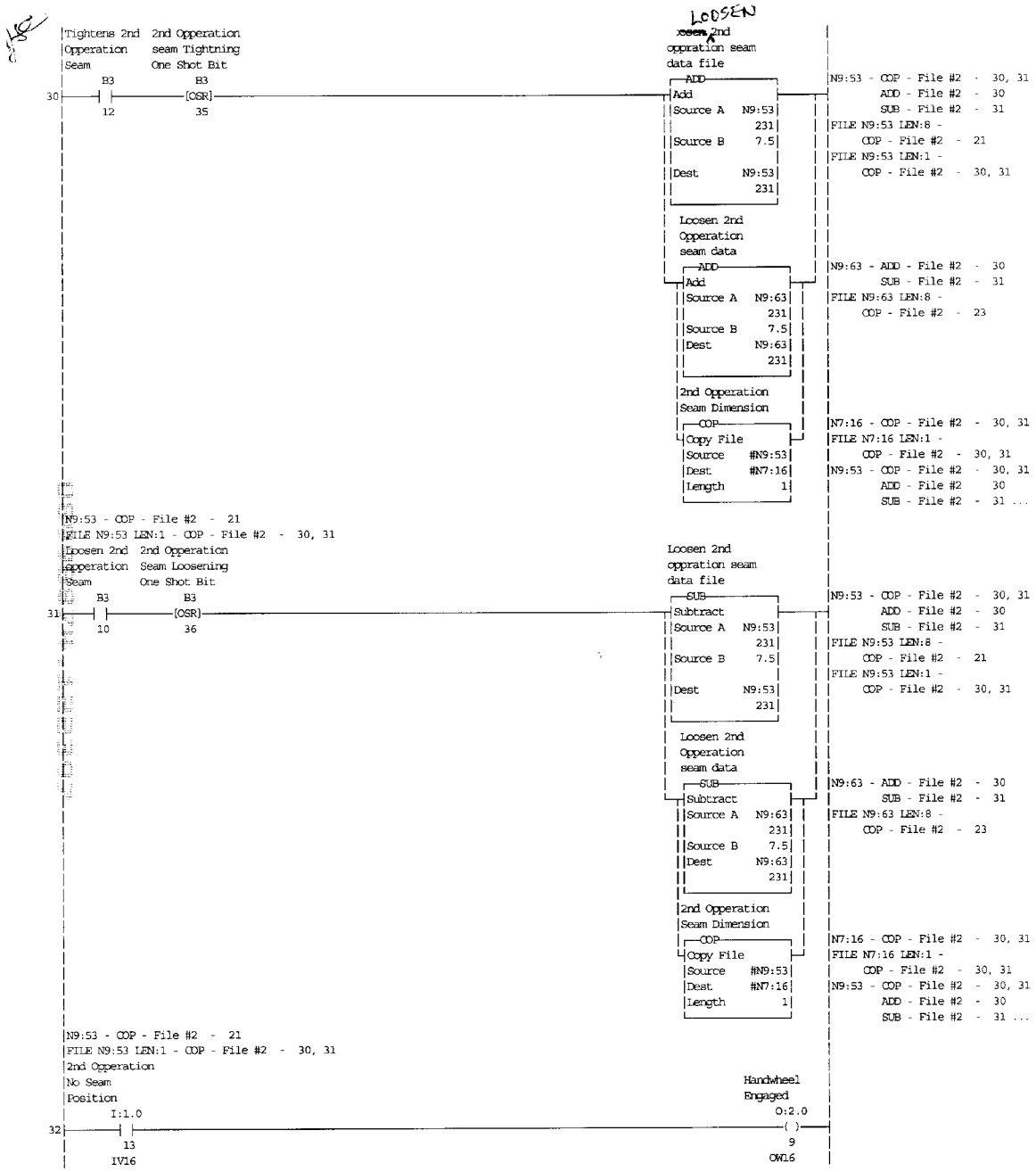
LOOSEN
Tightens 2nd Opperation Seam
2nd Opperation seam Tightning One Shot Bit
B3 12
B3 35
30
Loosen 2nd opperation seam data file
ADD
Add
Source A N9:53 231
Source B 7.5
Dest N9:53 231
Loosen 2nd Opperation seam data
ADD
Add
Source A N9:63 231
Source B 7.5
Dest N9:63 231
2nd Opperation Seam Dimension
COP
Copy File
Source #N9:53
Dest #N7:16
Length 1
N9:53 - COP - File #2 - 30, 31
ADD - File #2 - 30
SUB - File #2 - 31
FILE N9:53 LEN:8 -
COP - File #2 - 21
FILE N9:53 LEN:1 -
COP - File #2 - 30, 31
N9:63 - ADD - File #2 - 30
SUB - File #2 - 31
FILE N9:63 LEN:8 -
COP - File #2 - 23
N7:16 - COP - File #2 - 30, 31
FILE N7:16 LEN:1 -
COP - File #2 - 30, 31
N9:53 - COP - File #2 - 30, 31
ADD - File #2 30
SUB - File #2 - 31 ...
N9:53 - COP - File #2 - 21
FILE N9:53 LEN:1 - COP - File #2 - 30, 31
Loosen 2nd opperation Seam
2nd Opperation Seam Loosening One Shot Bit
B3 10
B3 36
31
Loosen 2nd opperation seam data file
SUB
Subtract
Source A N9:53 231
Source B 7.5
Dest N9:53 231
Loosen 2nd Opperation seam data
SUB
Subtract
Source A N9:63 231
Source B 7.5
Dest N9:63 231
2nd Opperation Seam Dimension
COP
Copy File
Source #N9:53
Dest #N7:16
Length 1
N9:53 - COP - File #2 - 30, 31
ADD - File #2 - 30
SUB - File #2 - 31
FILE N9:53 LEN:8 -
COP - File #2 - 21
FILE N9:53 LEN:1 -
COP - File #2 - 30, 31
N9:63 - ADD - File #2 - 30
SUB - File #2 - 31
FILE N9:63 LEN:8 -
COP - File #2 - 23
N7:16 - COP - File #2 - 30, 31
FILE N7:16 LEN:1 -
COP - File #2 - 30, 31
N9:53 - COP - File #2 - 30, 31
ADD - File #2 - 30
SUB - File #2 - 31 ...
N9:53 - COP - File #2 - 21
FILE N9:53 LEN:1 - COP - File #2 - 30, 31
2nd Opperation No Seam Position
I:1.0 13 IV16
32
Handwheel Engaged
O:2.0 9 OW16

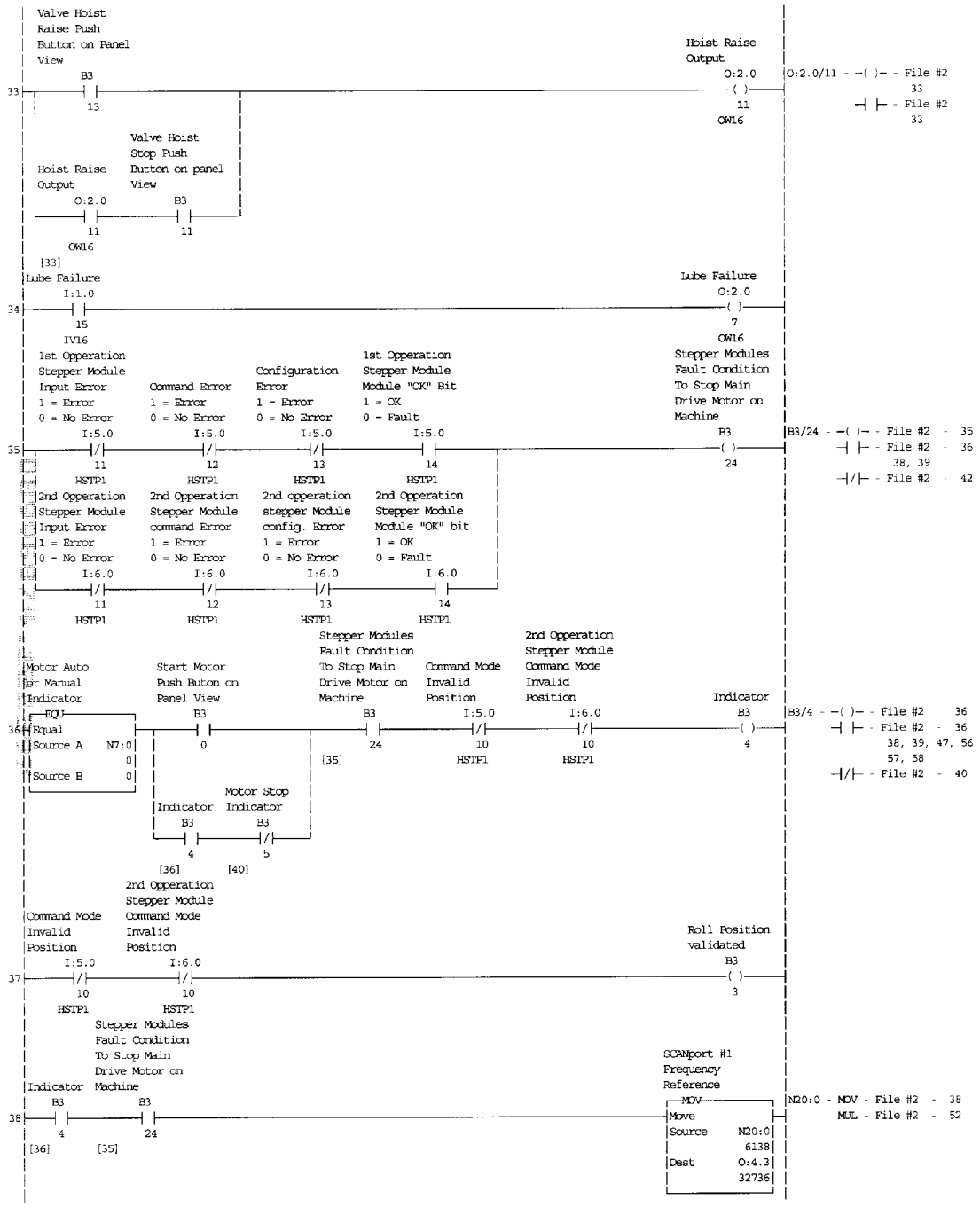
Valve Hoist Raise Push Button on Panel View
B3
13
Hoist Raise Output
O:2.0
11
OW16
Valve Hoist Stop Push Button on panel View
B3
11
O:2.0/11 - -( )- - File #2 33
- | |- - File #2 33
[33]
Lube Failure
I:1.0
15
IV16
Lube Failure
O:2.0
7
OW16
1st Opperation Stepper Module Input Error 1 = Error 0 = No Error
I:5.0
11
HSTP1
Command Error 1 = Error 0 = No Error
I:5.0
12
HSTP1
Configuration Error 1 = Error 0 = No Error
I:5.0
13
HSTP1
1st Opperation Stepper Module Module "OK" Bit 1 = OK 0 = Fault
I:5.0
14
HSTP1
Stepper Modules Fault Condition To Stop Main Drive Motor on Machine
B3
24
B3/24 - -( )- - File #2 - 35
- | |- - File #2 - 36
38, 39
-|/|- - File #2 - 42
2nd Opperation Stepper Module Input Error 1 = Error 0 = No Error
I:6.0
11
HSTP1
2nd Opperation Stepper Module command Error 1 = Error 0 = No Error
I:6.0
12
HSTP1
2nd opperation stepper Module config. Error 1 = Error 0 = No Error
I:6.0
13
HSTP1
2nd Opperation Stepper Module Module "OK" bit 1 = OK 0 = Fault
I:6.0
14
HSTP1
Motor Auto or Manual Indicator
EQU
Equal
Source A N7:0 0
Source B 0
Start Motor Push Buton on Panel View
B3
0
Stepper Modules Fault Condition To Stop Main Drive Motor on Machine
B3
24
[35]
Command Mode Invalid Position
I:5.0
10
HSTP1
2nd Opperation Stepper Module Command Mode Invalid Position
I:6.0
10
HSTP1
Indicator
B3
4
B3/4 - -( )- - File #2 36
- | |- - File #2 - 36
38, 39, 47, 56
57, 58
-|/|- - File #2 - 40
Indicator B3 4
[36]
Motor Stop Indicator B3 5
[40]
Command Mode Invalid Position
I:5.0
10
HSTP1
2nd Opperation Stepper Module Command Mode Invalid Position
I:6.0
10
HSTP1
Roll Position validated
B3
3
Indicator B3 4
[36]
Stepper Modules Fault Condition To Stop Main Drive Motor on Machine
B3
24
[35]
SCANport #1 Frequency Reference
MOV
Move
Source N20:0 6138
Dest O:4.3 32736
N20:0 - MOV - File #2 - 38
MUL - File #2 - 52

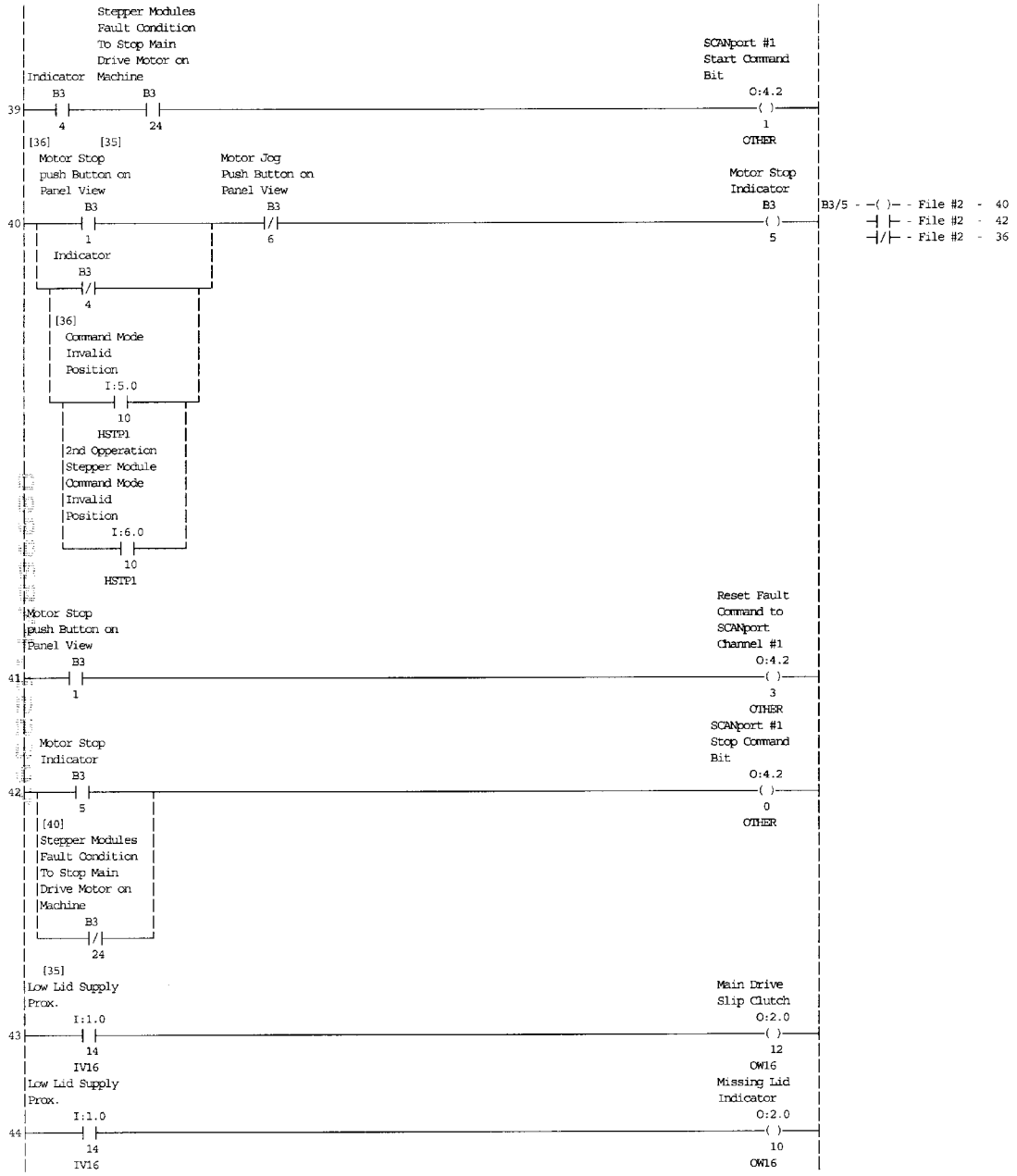
Stepper Modules
Fault Condition
To Stop Main
Drive Motor on
Machine
Indicator
B3
4
B3
24
SCANport #1
Start Command
Bit
O:4.2
1
OTHER
39
[36]
Motor Stop
push Button on
Panel View
B3
1
[35]
Motor Jog
Push Button on
Panel View
B3
6
Motor Stop
Indicator
B3
5
B3/5 - -( )- - File #2 - 40
File #2 - 42
File #2 - 36
40
Indicator
B3
4
[36]
Command Mode
Invalid
Position
I:5.0
10
HSTP1
2nd Opperation
Stepper Module
Command Mode
Invalid
Position
I:6.0
10
HSTP1
Motor Stop
push Button on
Panel View
B3
1
Reset Fault
Command to
SCANport
Channel #1
O:4.2
3
OTHER
41
Motor Stop
Indicator
B3
5
SCANport #1
Stop Command
Bit
O:4.2
0
OTHER
42
[40]
Stepper Modules
Fault Condition
To Stop Main
Drive Motor on
Machine
B3
24
[35]
Low Lid Supply
Prox.
I:1.0
14
IV16
Main Drive
Slip Clutch
O:2.0
12
OW16
43
Low Lid Supply
Prox.
I:1.0
14
IV16
Missing Lid
Indicator
O:2.0
10
OW16
44

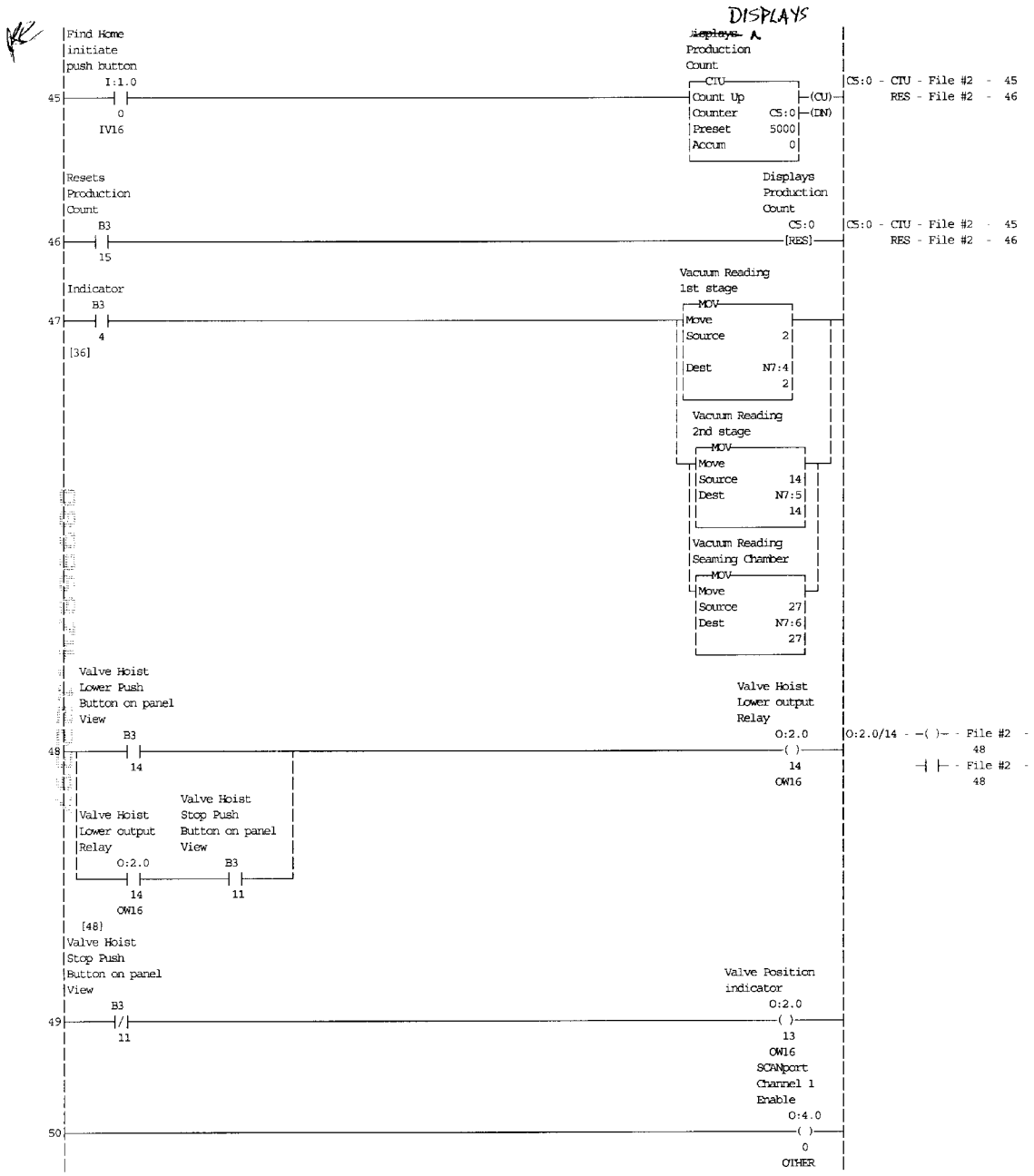
DISPLAYS
~~Displays~~
Find Home
initiate
push button
I:1.0
0
IV16
45
Production
Count
CTU
Count Up
Counter CS:0
Preset 5000
Accum 0
(CU)
(DN)
CS:0 - CTU - File #2 - 45
RES - File #2 - 46
Resets
Production
Count
B3
15
46
Displays
Production
Count
CS:0
[RES]
CS:0 - CTU - File #2 - 45
RES - File #2 - 46
Indicator
B3
4
[36]
47
Vacuum Reading
1st stage
MOV
Move
Source 2
Dest N7:4
2
Vacuum Reading
2nd stage
MOV
Move
Source 14
Dest N7:5
14
Vacuum Reading
Seaming Chamber
MOV
Move
Source 27
Dest N7:6
27
Valve Hoist
Lower Push
Button on panel
View
B3
14
48
Valve Hoist
Lower output
Relay
O:2.0
14
OW16
O:2.0/14 - -( )- - File #2 - 48
-| |- - File #2 - 48
Valve Hoist
Lower output
Relay
O:2.0
14
OW16
Valve Hoist
Stop Push
Button on panel
View
B3
11
[48]
Valve Hoist
Stop Push
Button on panel
View
B3
11
49
Valve Position
indicator
O:2.0
13
OW16
SCANport
Channel 1
Enable
O:4.0
0
OTHER
50

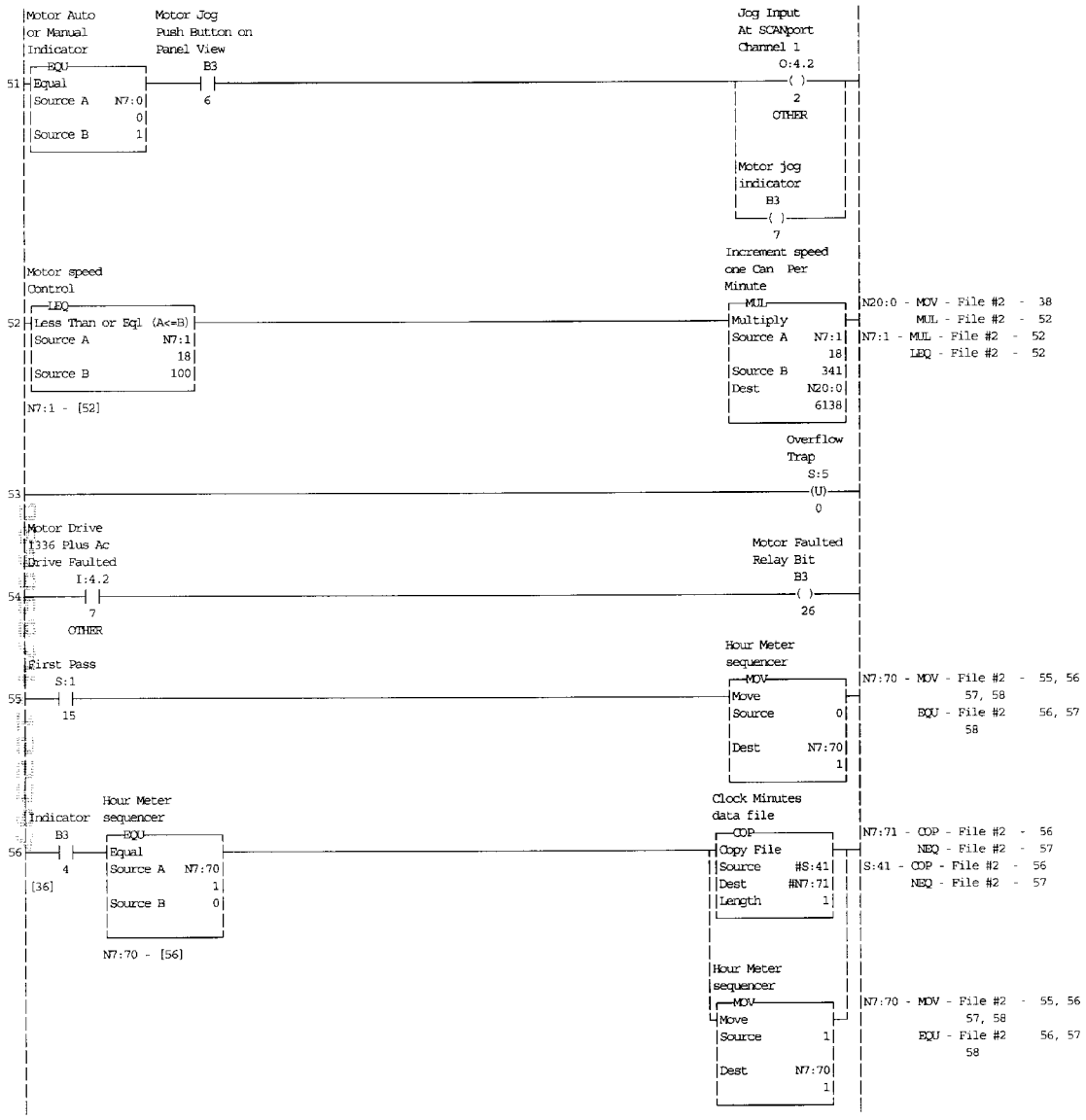
Motor Auto or Manual Indicator
EQU
Equal
Source A N7:0
0
Source B 1
Motor Jog Push Button on Panel View
B3
6
Jog Input At SCANport Channel 1
O:4.2
2
OTHER
Motor jog indicator
B3
7
Motor speed Control
LEQ
Less Than or Eql (A<=B)
Source A N7:1
18
Source B 100
N7:1 - [52]
Increment speed one Can Per Minute
MUL
Multiply
Source A N7:1
18
Source B 341
Dest N20:0
6138
N20:0 - MOV - File #2 - 38
MUL - File #2 - 52
N7:1 - MUL - File #2 - 52
LEQ - File #2 - 52
Overflow Trap
S:5
0
Motor Drive 1336 Plus Ac Drive Faulted
I:4.2
7
OTHER
Motor Faulted Relay Bit
B3
26
First Pass
S:1
15
Hour Meter sequencer
MOV
Move
Source 0
Dest N7:70
1
N7:70 - MOV - File #2 - 55, 56 57, 58
EQU - File #2 56, 57 58
Indicator
B3
4
[36]
Hour Meter sequencer
EQU
Equal
Source A N7:70
1
Source B 0
N7:70 - [56]
Clock Minutes data file
COP
Copy File
Source #S:41
Dest #N7:71
Length 1
N7:71 - COP - File #2 - 56
NEQ - File #2 - 57
S:41 - COP - File #2 - 56
NEQ - File #2 - 57
Hour Meter sequencer
MOV
Move
Source 1
Dest N7:70
1
N7:70 - MOV - File #2 - 55, 56 57, 58
EQU - File #2 56, 57 58

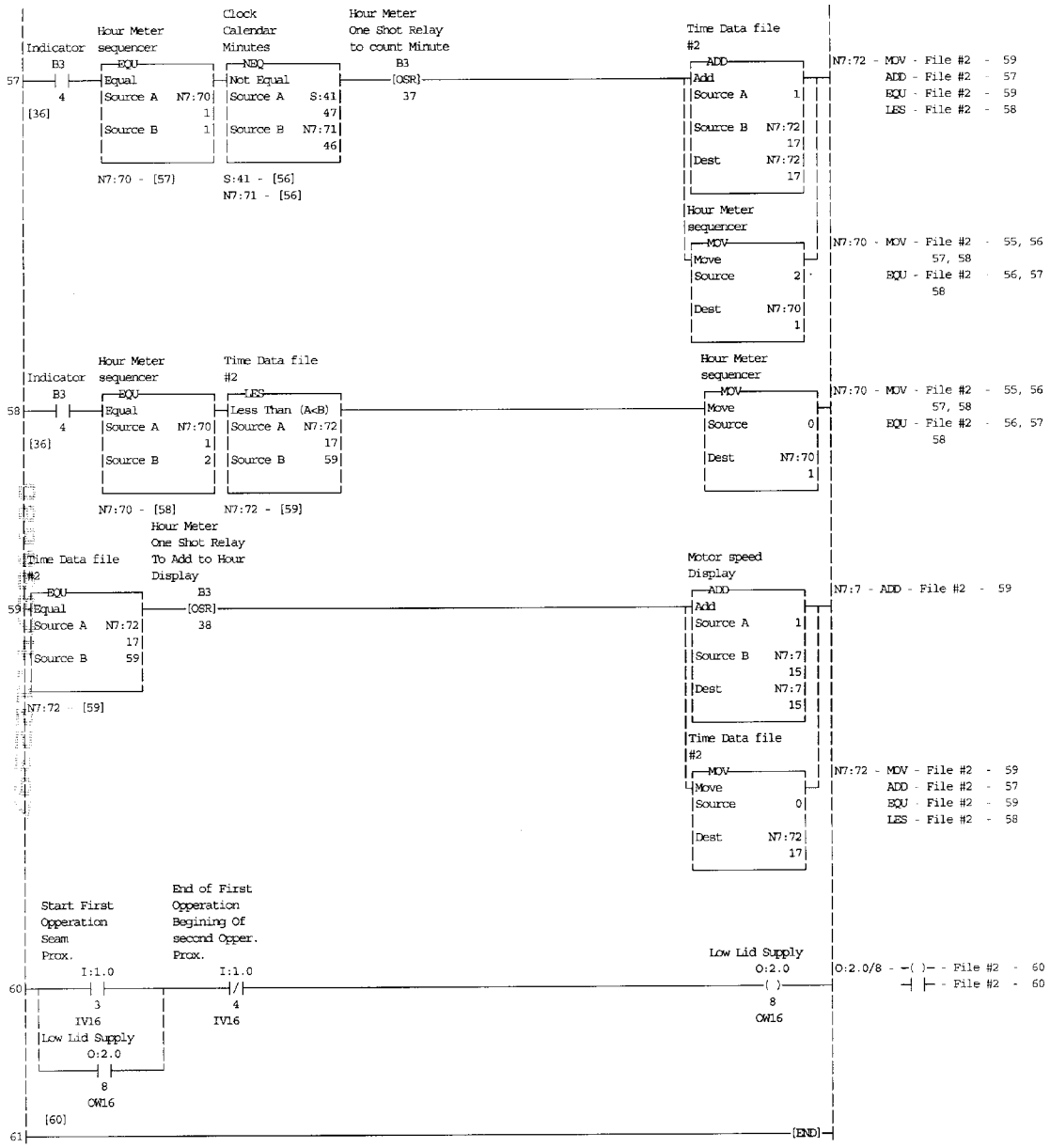
Indicator B3 4 [36]
Hour Meter sequencer
EQU Equal Source A N7:70 1 Source B 1
N7:70 - [57]
Clock Calendar Minutes
NEQ Not Equal Source A S:41 47 Source B N7:71 46
S:41 - [56]
N7:71 - [56]
Hour Meter One Shot Relay to count Minute
B3 [OSR] 37
Time Data file #2
ADD Add Source A 1 Source B N7:72 17 Dest N7:72 17
N7:72 - MOV - File #2 - 59
ADD - File #2 - 57
EQU - File #2 - 59
LES - File #2 - 58
Hour Meter sequencer
MOV Move Source 2 Dest N7:70 1
N7:70 - MOV - File #2 - 55, 56 57, 58
EQU - File #2 - 56, 57 58
Indicator B3 4 [36]
Hour Meter sequencer
EQU Equal Source A N7:70 1 Source B 2
N7:70 - [58]
Time Data file #2
LES Less Than (A<B) Source A N7:72 17 Source B 59
N7:72 - [59]
Hour Meter sequencer
MOV Move Source 0 Dest N7:70 1
N7:70 - MOV - File #2 - 55, 56 57, 58
EQU - File #2 - 56, 57 58
Time Data file #2
EQU Equal Source A N7:72 17 Source B 59
N7:72 - [59]
Hour Meter One Shot Relay To Add to Hour Display
B3 [OSR] 38
Motor speed Display
ADD Add Source A 1 Source B N7:7 15 Dest N7:7 15
N7:7 - ADD - File #2 - 59
Time Data file #2
MOV Move Source 0 Dest N7:72 17
N7:72 - MOV - File #2 - 59
ADD - File #2 - 57
EQU - File #2 - 59
LES - File #2 - 58
Start First Opperation Seam Prox.
I:1.0 3 IV16
Low Lid Supply O:2.0 8 OW16
[60]
End of First Opperation Begining Of second Opper. Prox.
I:1.0 4 IV16
Low Lid Supply O:2.0 8 OW16
O:2.0/8 - -( )- - File #2 - 60
- File #2 - 60
[END]

I claim:

1. A container seaming machine comprising:

(a) a seaming chuck for holding a lid firmly against an end of a container body during a seaming operation;

(b) a first seaming roller;

(c) a first drive connected to the first seaming roller for positioning the first seaming roller with respect to a circumferential edge of the lid; and (d) a second drive for causing rotation of the first seaming roller with respect to the chuck, container body and container lid, the first drive and the second drive being independently controllable from each other.

2. A machine according to claim 1 wherein the first drive adjustably positions the first seaming roller toward and away from a center axis of the container body, thereby positioning the first seaming roller with respect to the circumferential edge of the lid.

3. A machine according to claim 2 further comprising:

(e) a controller for independently controlling the first and the second drive so that the position of the first seaming roller with respect to the circumferential edge of the lid and the position of the first seaming roller with respect to the container body and container lid during the rotation are coordinated to perform a seaming operation.

4. A machine according to claim 3 wherein the controller is programmable to output a set of instructions for a specified container body diameter, the instruction including position instructions for the first drive and rotation instructions for the second drive.

5. A machine according to claim 4 wherein the controller includes an input for receiving data regarding the diameter of container bodies to be seamed, the position instructions for the first drive being adjustable based on the diameter data.

6. A machine according to claim 5 wherein the position instructions for the first drive are adjustable while the machine is in operation, thereby causing a new set of position instructions to be output from the controller without having to stop the machine.

7. A machine according to claim 5 wherein the input is an operator input device associated with the controller.

8. A machine according to claim 5 wherein the input is adapted to receive the diameter from an automated measuring device.

9. A machine according to claim 4 wherein the controller includes an input for receiving feedback data regarding seamed containers, the position instructions for the first drive being adjustable based on the feedback data.

10. A machine according to claim 9 wherein the position instructions for the first drive resulting from the feedback data are adjustable while the machine is in operation, thereby causing a new set of position instructions to be output from the controller without having to stop the machine.

11. A machine according to claim 3 wherein the controller is programmable to output a plurality of different sets of instructions, each set of instructions relating to a specified container body size and including position instructions for the first drive and rotation instructions for the second drive.

12. A machine according to claim 11 wherein the controller has an input for allowing the container size to be changed while the machine is in operation, thereby causing an new set of instructions to be output without having to stop the machine.

13. A machine according to claim 3 wherein the controller is a programmable controller for independently controlling the first and second drives based upon a stored program.

14. A machine according to claim 3 wherein the controller controls the first drive to intermittently engage and disengage the first seaming roller from a seaming position during rotation of the first seaming roller with respect to the chuck, container body and container lid, thereby allowing the machine to perform spot clinching on the container body.

15. A machine according to claim 1 further comprising:

(e) a third drive for adjusting the relative vertical position of the container end with respect to the first seaming roller so that the machine may accommodate container bodies of different heights.

16. A machine according to claim 15 further comprising a controller for outputting position instructions for the third drive.

17. A machine according to claim 16 wherein the controller has an input for receiving height data regarding container bodies to be seamed, the controller using the height data to output the position instructions for the third drive.

18. A machine according to claim 17 wherein the height data is received from an automated container body height measuring device.

19. A machine according to claim 17 wherein the height data is received from an operator input device associated with the controller.

20. A machine according to claim 17 wherein the position instructions for the third drive are adjustable while the machine is in operation, thereby causing a new set of position instructions for the third drive to be output from the controller without having to stop the machine.

21. A machine according to claim 15 wherein the container body has another end, the machine further comprising a base surface for placing the other end of the container body thereon, the third drive causing the base surface to move toward the seaming chuck so that the end of the container body and the lid are held firmly against the seaming chuck.

22. A machine according to claim 15 wherein the third drive includes:

(i) a servomotor for receiving control data related to the desired vertical position of the container end with respect to the first seaming roller, the servomotor having an output; and (ii) a linear actuator for translating the servomotor output to cause the appropriate vertical movement of the container end with respect to the first seaming roller prior to a seaming operation.

23. A machine according to claim 1 wherein the first drive includes:

(i) a servomotor for receiving control data related to the desired position of the first seaming roller with respect to the circumferential edge of the container body, and the container lid, the servomotor having an output;

(ii) a linear actuator for translating the servomotor output to cause movement of the first seaming roller.

24. A machine according to claim 23 wherein the servomotor is a stepper motor.

25. A machine according to claim 23 wherein the linear actuator is a ball screw mechanism.

26. A machine according to claim 23 wherein the linear actuator is a pneumatic cylinder.

27. A machine according to claim 1 further comprising:

(e) a second seaming roller;

(f) a third drive connected to the second seaming roller for positioning the second seaming roller with respect to the circumferential edge of the lid, wherein the third drive is independently controllable from the first and the second drives.

28. A machine according to claim 27 wherein the first seaming roller begins to roll the lid and the container body, and the second seaming roller completes the seam, the first drive and the third drive being coordinated to position the first and second rollers with respect to the circumferential edge of the lid to cause the first and second seaming rollers to form a double seam.

29. A machine according to claim 1 wherein the first and second drives are independently controllable while the machine is in operation.

30. A machine according to claim 1 wherein the second drive causes rotation of the seaming chuck, thereby causing rotation of the container body and container lid.

31. A machine according to claim 1 further comprising:

(e) a programmable controller for independently controlling the first and the second drive so that the position of the first seaming roller with respect to the circumferential edge of the lid and the position of the first seaming roller with respect to the container body and container lid during the rotation are coordinated to perform a seaming operation.

32. A machine according to claim 1 further comprising:

(e) a programmable controller for independently controlling the first and second drive so that the drives are coordinated to perform a seaming operation.

33. A machine according to claim 1 wherein the first drive includes a linear actuator for causing movement of the first seaming roller.

34. A container seaming machine comprising:

(a) a seaming chuck for holding a lid firmly against an end of a container body during a seaming operation;

(b) a first drive for causing rotation of the seaming chuck, thereby causing rotation of the container body and container lid;

(c) a seaming roller; and (d) a second drive connected to the seaming roller for positioning the seaming roller with respect to a circumferential edge of the lid, the first drive and the second drive being independently controllable from each other.

35. A machine according to claim 34 further comprising:

(e) a programmable controller for independently controlling the first and the second drive so that the position of the seaming roller with respect to the circumferential edge of the lid and the position of the seaming roller with respect to the container body and container lid during the rotation are coordinated to perform a seaming operation.

36. A method of seaming containers comprising the steps of:

(a) holding a container lid firmly against an end of a container body by using a seaming chuck;

(b) positioning a seaming roller with respect to a circumferential edge of the lid;

(c) rotating the seaming roller with respect to the chuck, container body and container lid while simultaneously and independently positioning the seaming roller with respect to the circumferential edge of the lid to seam the lid to the container body.

37. A method according to claim 36 wherein step (b) is performed by a first drive and step (c) is performed by a second drive, the method further comprising the step of:

(e) programming a controller to independently control the first and second drive so that the drives are coordinated to perform a seaming operation; and (f) outputting control data from the controller to control the first and second drives.

38. A method according to claim 37 wherein steps (a)–(c) are performed by a seaming machine, the method further comprising the steps of:

(g) measuring seams of seamed container bodies and obtaining seam data;

(h) comparing the seam data to desired seam values, and (i) adjusting the control data output by the controller based upon the results of the comparison while the machine is in operation, and without having to stop the machine.

39. A method according to claim 38 wherein the seam data is communicated to a location remote from where the seaming operation is performed and step (h) is performed at the remote location, the method further comprising the step of:

(j) sending adjustment instructions from the remote location to the controller, and using the adjustment instructions to perform step (i).

40. A method according to claim 37 wherein step (e) further comprises the step of programming the controller to output a plurality of different sets of instructions, each set of instructions relating to a specified container body size and including position instructions for the first drive and rotation instructions for the second drive.

41. A method according to claim 36 wherein in step (c), the seaming chuck is rotated, thereby causing rotation of the container body and lid with respect to the seaming roller.

42. A method according to claim 36 wherein step (b) further comprises adjustably positioning the seaming roller toward and away from a center axis of the container body, thereby positioning the seaming roller with respect to the circumferential edge of the lid.

* * * * *